US006199626B1

(12) United States Patent
Wu et al.

(10) Patent No.: US 6,199,626 B1
(45) Date of Patent: Mar. 13, 2001

(54) SELF-ENCLOSING HEAT EXCHANGERS

(75) Inventors: Alan K. Wu, Kitchener; Allan K. So, Mississauga; Bruce L. Evans, Burlington, all of (CA); Thomas F. Lemczyk, Baton Rouge, LA (US)

(73) Assignee: Long Manufacturing Ltd., Oakville (CA)

( * ) Notice: Subject to any disclaimer, the term of this patent is extended or adjusted under 35 U.S.C. 154(b) by 0 days.

(21) Appl. No.: 09/497,662

(22) Filed: Feb. 4, 2000

(30) Foreign Application Priority Data

Feb. 5, 1999 (CA) ..... 2260890

(51) Int. Cl.[7] ..... F28F 3/08; F28F 3/00
(52) U.S. Cl. ..... 165/167; 165/166
(58) Field of Search ..... 165/165, 166, 165/167, 916

(56) References Cited

U.S. PATENT DOCUMENTS

| | | | | |
|---|---|---|---|---|
| 3,240,268 | | 3/1966 | Armes . | |
| 4,327,802 | | 5/1982 | Beldam . | |
| 4,592,414 | * | 6/1986 | Beasley | 165/167 |
| 4,696,342 | * | 9/1987 | Yamauchi et al. | 165/167 |
| 5,222,551 | * | 6/1993 | Hasegawa et al. | 165/167 |
| 5,291,945 | | 3/1994 | Blomgren et al. . | |
| 5,307,869 | | 5/1994 | Blomgren . | |
| 5,884,696 | * | 3/1999 | Loup | 165/167 |

FOREIGN PATENT DOCUMENTS

| | | | | |
|---|---|---|---|---|
| 163069 | * | 3/1954 | (AU) | 165/166 |
| 0 742 418 A2 | | 11/1996 | (EP) . | |
| 611941 | * | 8/1994 | (GB) | 165/167 |

* cited by examiner

*Primary Examiner*—Ira S. Lazarus
*Assistant Examiner*—Tho Duong
(74) *Attorney, Agent, or Firm*—Ridout & Maybee

(57) ABSTRACT

Self-enclosing heat exchangers are made from stacked plates having raised peripheral flanges on one side of the plates and continuous peripheral ridges on the other side of the plates, so that when the plates are put together, fully enclosed alternating flow channels are provided between the plates. The plates have raised bosses defining flow ports that line-up in the stacked plates to form manifolds for the flow of heat exchange fluids through alternate plates. Rib and groove barriers are formed in the plates inside the peripheral flanges and ridges. The barriers prevent short circuit flow on one side of the plates and promote flow to remote areas on the other side of the plates, to improve the overall efficiency of the heat exchangers.

28 Claims, 15 Drawing Sheets

SELF-ENCLOSING HEAT EXCHANGERS

BACKGROUND OF THE INVENTION

This invention relates to heat exchangers of the type formed of stacked plates, wherein the plates have raised peripheral flanges that co-operate to form an enclosure for the passage of heat exchange fluids between the plates.

The most common kind of plate type heat exchangers produced in the past have been made of spaced-apart stacked pairs of plates where the plate pairs define internal flow passages therein. The plates normally have inlet and outlet openings that are aligned in the stacked plate pairs to allow for the flow of one heat exchange fluid through all of the plate pairs. A second heat exchange fluid passes between the plate pairs, and often an enclosure or casing is used to contain the plate pairs and cause the second heat exchange fluid to pass between the plate pairs.

In order to eliminate the enclosure or casing, it has been proposed to provide the plates with peripheral flanges that not only close the peripheral edges of the plate pairs, but also close the peripheral spaces between the plate pairs. One method of doing this is to use plates that have a raised peripheral flange on one side of the plate and a raised peripheral ridge on the other side of the plate. Examples of this type of heat exchanger are shown in U.S. Pat. No. 3,240,268 issued to F. D. Armes and U.S. Pat. No. 4,327,802 issued to Richard P. Beldam.

A difficulty with the self-enclosing plate-type heat exchangers produced in the past, however, is that the peripheral flanges and ridges form inherent peripheral flow channels that act as short-circuits inside and between the plate pairs, and this reduces the heat exchange efficiency of these types of heat exchangers.

SUMMARY OF THE INVENTION

In the present invention, ribs and grooves are formed in the plates inside the peripheral flanges and ridges, and these ribs and grooves act as barriers to reduce short-circuit flow on one side of the plates and promote flow on the other side of the plates to improve the flow distribution between the plates and the overall heat exchange efficiency of the heat exchangers.

According to one aspect of the invention, there is provided a plate type heat exchanger comprising first and second plates, each plate including a planar central portion, a first pair of spaced-apart bosses extending from one side of the planar central portion, and a second pair of spaced-apart bosses extending from the opposite side of the planar central portion. The bosses each have an inner peripheral edge portion and an outer peripheral edge portion defining a fluid port. A continuous ridge encircles the inner peripheral edge portions of at least the first pair of bosses and extends from the planar central portion in the same direction and equidistantly with the outer peripheral edge portions of the second pair of bosses. Each plate includes a raised peripheral flange extending from the planar central portion in the same direction and equidistantly with the outer peripheral edge portions of the first pair of bosses. The first and second plates are juxtaposed so that one of: the continuous ridges are engaged and the plate peripheral flanges are engaged; thereby defining a first flow chamber between the engaged ridges or peripheral flanges. The fluid ports in their respective first and second pairs of spaced-apart bosses are in registration. A third plate is located in juxtaposition with one of the first and second plates to define a second fluid chamber between the third plate and the central planar portion of the adjacent plate. Also, each planar central portion includes a barrier formed of a rib and complimentary groove. The rib is located between the inner peripheral edge portions of the bosses of one of the pairs of bosses to reduce short-circuit flow therebetween. The complimentary groove is also located between the bosses of the one pair of bosses to promote flow therebetween.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENTS

Figure 1:
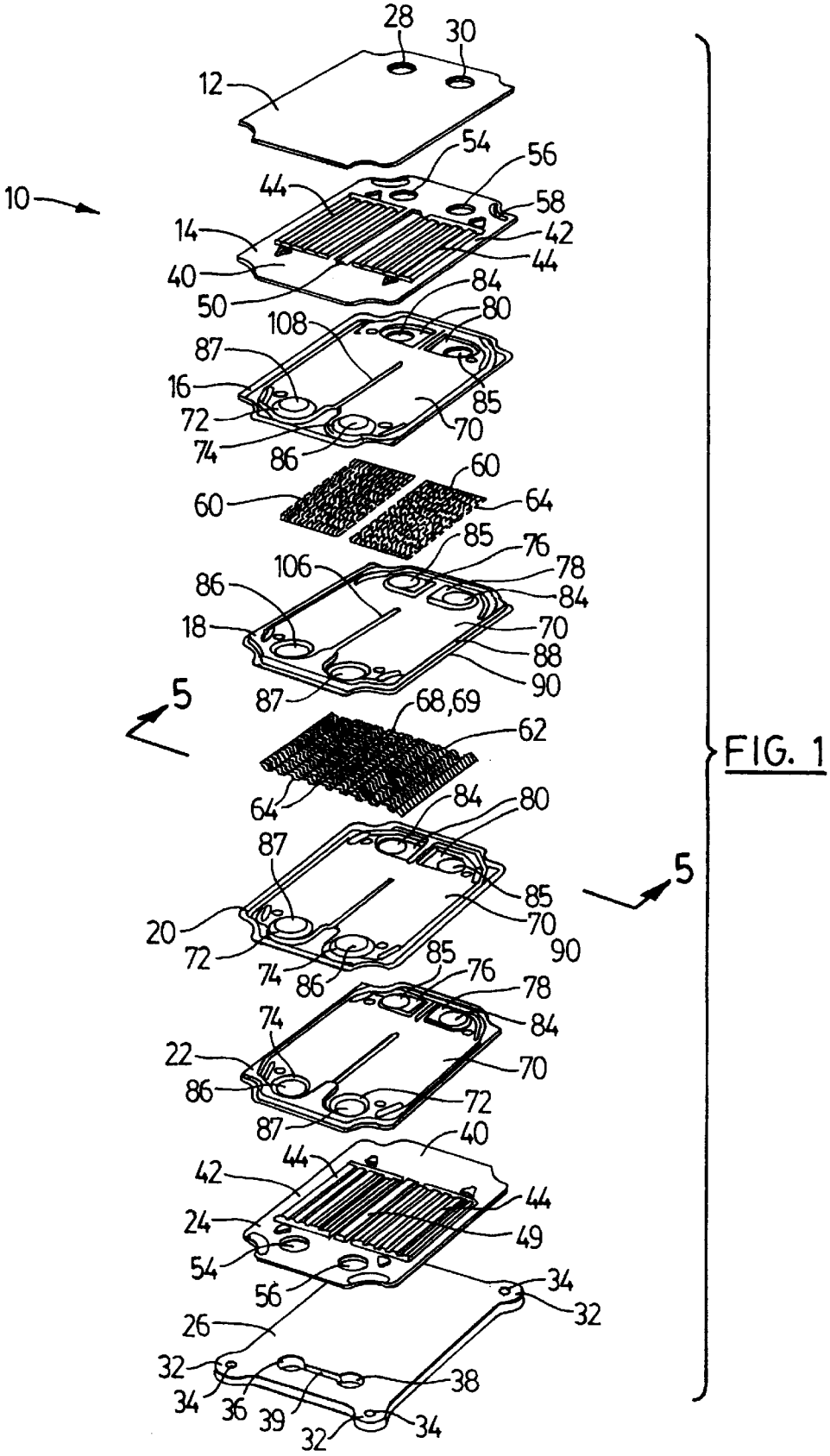
FIG. 1 is an exploded perspective view of a first preferred embodiment of a self-enclosing heat exchanger made in accordance with the present invention.
Figure 2:
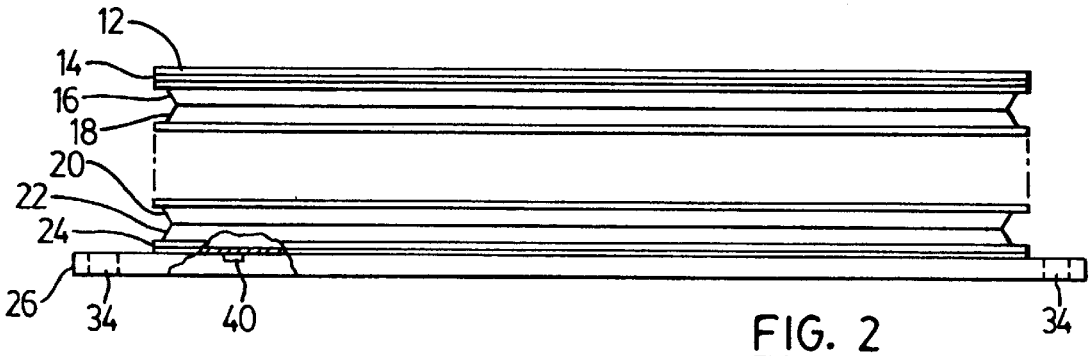
FIG. 2 is an enlarged elevational view of the assembled heat exchanger of FIG. 1.

Referring firstly to FIGS. 1 and 2, an exploded perspective view of a preferred embodiment of a heat exchanger according to the present invention is generally indicated by reference numeral 10. Heat exchanger 10 includes a top or end plate 12, a turbulizer plate 14, core plates 16, 18, 20 and 22, another turbulizer plate 24 and a bottom or end plate 26. Plates 12 through 26 are shown arranged vertically in FIG. 1, but this is only for the purposes of illustration. Heat exchanger 10 can have any orientation desired.

Top end plate 12 is simply a flat plate formed of aluminum having a thickness of about 1 mm. Plate 12 has openings 28, 30 adjacent to one end thereof to form an inlet and an outlet for a first heat exchange fluid passing through heat exchanger 10. The bottom end plate 26 is also a flat aluminum plate, but plate 26 is thicker than plate 12 because it also acts as a mounting plate for heat exchanger 10. Extended corners 32 are provided in plate 26 and have openings 34 therein to accommodate suitable fasteners (are shown) for the mounting of heat exchanger 10 in a desired location. End plate 26 has a thickness typically of about 4 to 6 mm. End plate 26 also has openings 36, 38 to form respective inlet and outlet openings for a second heat exchange fluid for heat exchanger 10. Suitable inlet and outlet fittings or nipples (not shown) are attached to the plate inlets and outlets 36 and 38 (and also openings 28 and 30 in end plate 12) for the supply and return of the heat exchange fluids to heat exchanger 10.

Although it is normally not desirable to have short-circuit or bypass flow inside the heat exchanger core plates, in some applications, it is desirable to have some bypass flow in the flow circuit that includes heat exchanger 10. This bypass, for example, could be needed to reduce the pressure drop in heat exchanger 10, or to provide some cold flow bypass between the supply and return lines to heat exchanger 10. For this purpose, an optional controlled bypass groove 39 may be provided between openings 36, 38 to provide some deliberate bypass flow between the respective inlet and outlet formed by openings 36, 38.

Figure 3:
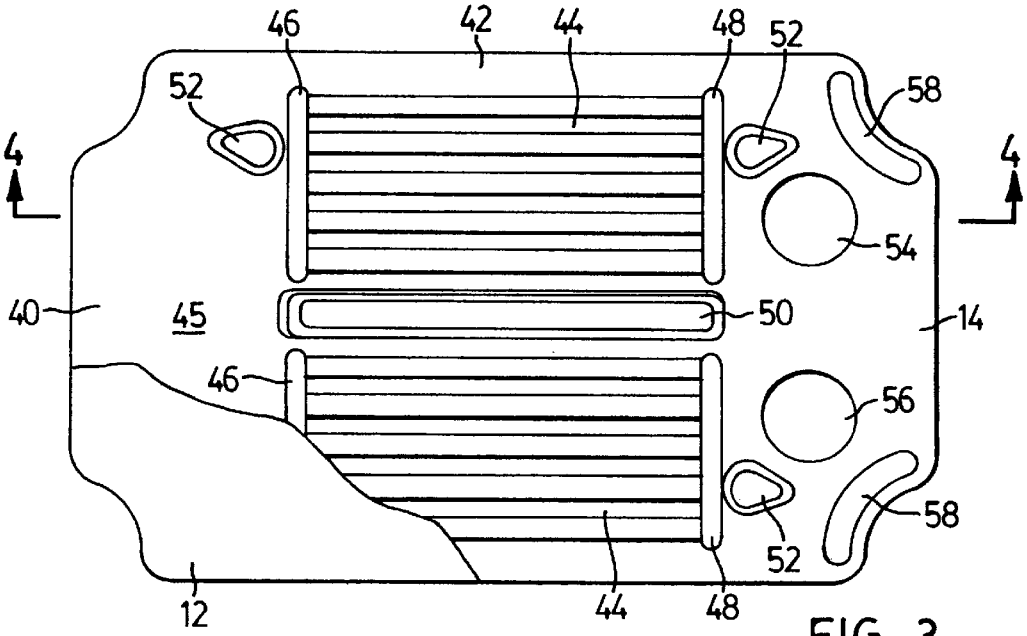
FIG. 3 is a plan view of the top two plates shown in FIG. 1, the top plate being broken away to show the plate beneath it.
Figure 4:
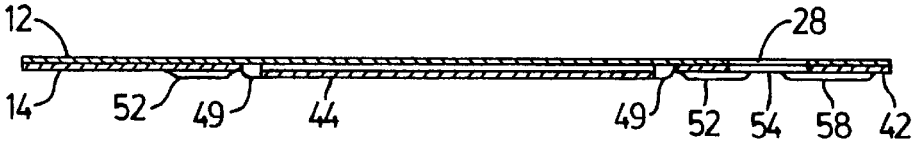
FIG. 4 is a vertical sectional view taken along lines 4—4 of FIG. 3, but showing both plates of FIG. 3.
Figure 5:
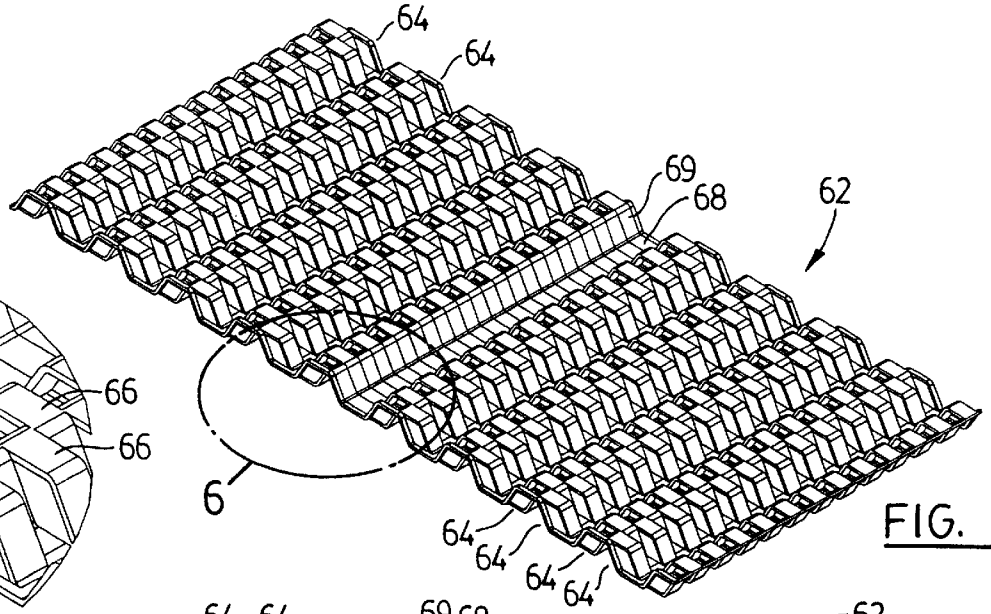
FIG. 5 is an enlarged perspective view taken along lines 5—5 of FIG. 1 showing one of the turbulizers used in the embodiment shown in FIG. 1.
Figure 6:
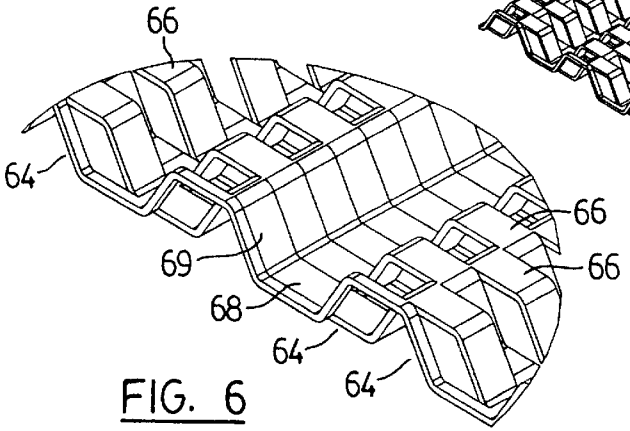
FIG. 6 is an enlarged scrap view of the portion of FIG. 5 indicated by circle 6 in FIG. 5.
Figure 7:
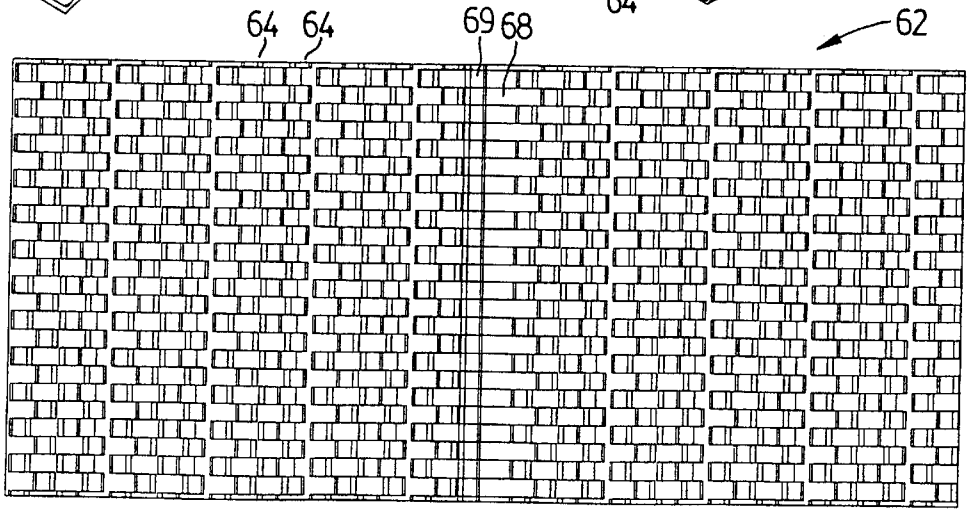
FIG. 7 is a plan view of the turbulizer shown in FIG. 5.

Referring next to FIGS. 1, 3 and 4, turbulizer plates 14 and 24 will be described in further detail. Turbulizer plate 14 is identical to turbulizer plate 24, but in FIG. 1, turbulizer plate 24 has been turned end-for-end or 180° with respect to turbulizer plate 14, and turbulizer plate 24 has been turned upside down with respect to turbulizer plate 14. The following description of turbulizer plate 14, therefore, also applies to turbulizer plate 24. Turbulizer plate 14 may be referred to as a shim plate, and it has a central planar portion 40 and a peripheral edge portion 42. Undulating passageways 44 are formed in central planar portion 40 and are located on one side only of central planar portion 40, as seen best in FIG. 4. This provides turbulizer plate 14 with a flat top surface 45 to engage the underside of end plate 12. Openings 46, 48 are located at the respective ends of undulating passages 44 to allow fluid to flow longitudinally through the undulating passageways 44 between top or end plate 12 and turbulizer 14. A central longitudinal rib 49, which appears as a groove 50 in FIG. 3, is provided to engage the core plate 16 below it as seen in FIG. 1. Turbulizer plate 14 is also provided with dimples 52, which also extend downwardly to engage core plate 16 below turbulizer 14. Openings 54 and 56 are also provided in turbulizer 14 to register with openings 28,30 in end plate 12 to allow fluid to flow transversely through turbulizer plate 14. Corner arcuate dimples 58 are also provided in turbulizer plate 14 to help locate turbulizer plate 14 in the assembly of heat exchanger 10. If desired, arcuate dimples 58 could be provided at all four corners of turbulizer plate 14, but only two are shown in FIGS. 1 to 3. These arcuate dimples also strengthen the corners of heat exchanger 10.

Referring next to FIGS. 1 and 5 to 7, heat exchanger 10 includes turbulizers 60 and 62 located between respective plates 16 and 18 and 18 and 20. Turbulizers 60 and 62 are formed of expanded metal, namely, aluminum, either by roll forming or a stamping operation. Staggered or offset transverse rows of convolutions 64 are provided in turbulizers 60, 62. The convolutions have flat tops 66 to provide good bonds with core plates 14, 16 and 18, although they could have round tops, or be in a sine wave configuration, if desired. Any type of turbulizer can be used in the present invention. As seen best in FIGS. 5 to 7, one of the transverse rows of convolutions 64 is compressed or roll formed or crimped together with its adjacent row to form transverse crimped portions 68 and 69. For the purposes of this disclosure, the term crimped is intended to include crimping, stamping or roll forming, or any other method of closing up the convolutions in the turbulizers. Crimped portions 68, 69 reduces short-circuit flow inside the core plates, as will be discussed further below. It will be noted that only turbulizers 62 have crimped portions 68,. Turbulizers 60 do not have such crimped portions.

As seen best in FIG. 1, turbulizers 60 are orientated so that the transverse rows of convolutions 64 are arranged transversely to the longitudinal direction of core plates 16 and 18. This is referred to as a high pressure drop arrangement. In contrast, in the case of turbulizer 62, the transverse rows of convolutions 64 are located in the same direction as the longitudinal direction of core plates 18 and 20. This is referred to as the low pressure drop direction for turbulizer 62, because there is less flow resistance for fluid to flow through the convolutions in the same direction as row 64, as there is for the flow to try to flow through the row 64, as is the case with turbulizers 60.

Figure 8:
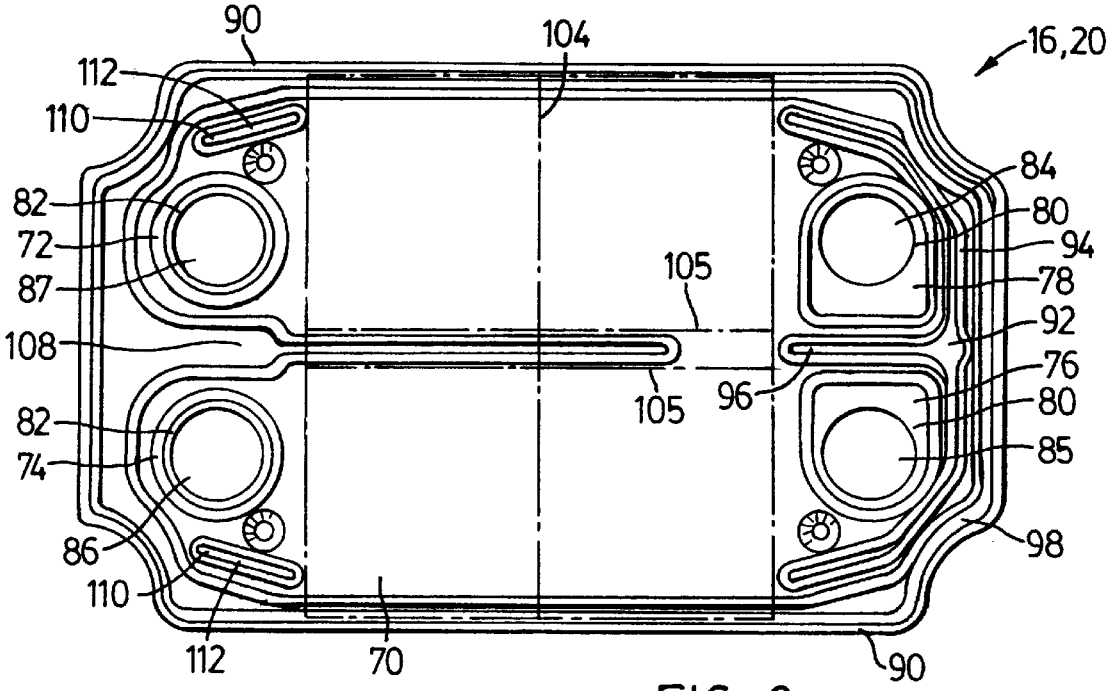
FIG. 8 is a plan view of one side of one of the core plates used in the heat exchanger of FIG. 1.
Figure 9:
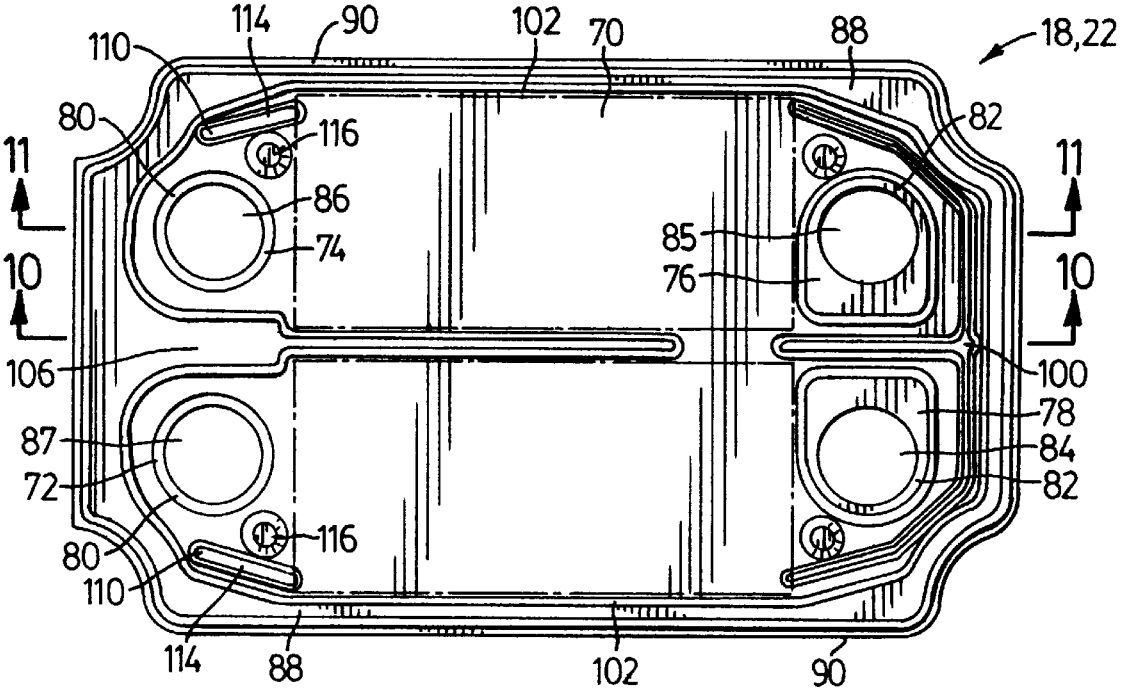
FIG. 9 is a plan view of the opposite side of the core plate shown in FIG. 8.
Figure 10:
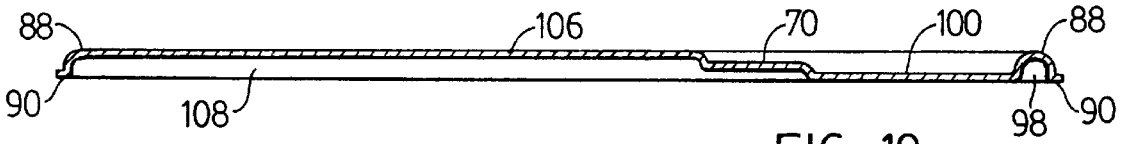
FIG. 10 is a vertical sectional view taken along lines 10—10 of FIG. 9.
Figure 11:
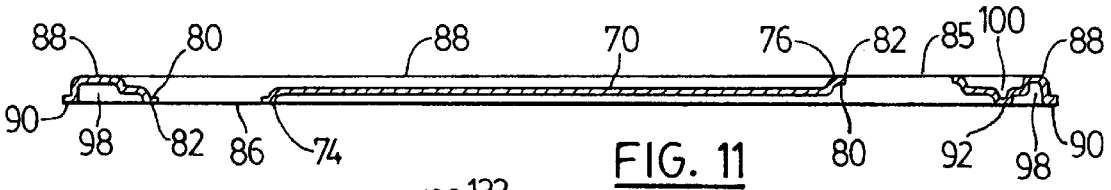
FIG. 11 is a vertical sectional view taken along lines 11—11 of FIG. 9.

Referring next to FIGS. 1 and 8 to 11, core plates 16, 18, 20 and 22 will now be described in detail. All of these core plates are identical, but in the assembly of heat exchanger 10, alternating core plates are turned upside down. FIG. 8 is a plan view of core plates 16 and 20, and FIG. 9 is a plan view of core plates 18 and 22. Actually, FIG. 9 shows the back or underside of the plate of FIG. 8. Where heat exchanger 10 is used to cool oil using coolant such as water, for example, FIG. 8 would be referred to as the water side of the core plate and FIG. 9 would be referred to as the oil side of the core plate.

Core plates 16 through 22 each have a planar central portion 70 and a first pair of spaced-apart bosses 72, 74 extending from one side of the planar central portion 70, namely the water side as seen in FIG. 8. A second pair of spaced-apart bosses 76, 78 extends from the opposite side of planar central portion 70, namely the oil side as seen in FIG. 9. The bosses 72 through 78 each have an inner peripheral edge portion 80, and an outer peripheral edge portion 82. The inner and outer peripheral edge portions 80, 82 define openings or fluid ports 84, 85, 86 and 87. A continuous peripheral ridge 88 (see FIG. 9) encircles the inner peripheral edge portions 80 of at least the first pair of bosses 72, 74, but usually continuous ridge 88 encircles all four bosses 72,74, 76 and 78 as shown in FIG. 9. Continuous ridge 88 extends from planar central portion 70 in the same direction and equidistantly with the outer peripheral edge portions 82 of the second pair of bosses 76, 78.

Each of the core plate 16 to 22 also includes a raised peripheral flange 90 which extends from planar central portion 70 in the same direction and equidistantly with the outer peripheral edge portions 82 of the first pair of bosses 72, 74.

As seen in FIG. 1, core plates 16 and 18 are juxtaposed so that continuous ridges 88 are engaged to define a first fluid chamber between the respective plate planar central portions 70 bounded by the engaged continuous ridges 88. In other words, plates 16, 18 are positioned back-to-back with the oil sides of the respective plates facing each other for the flow of a first fluid, such as oil, between the plates. In this configuration, the outer peripheral edge portions 82 of the second pair of spaced-apart bosses 76,78 are engaged, with the respective fluid ports 85,84 and 84,85 in communication. Similarly, core plates 18 and 20 are juxtaposed so that their respective peripheral flanges 90 are engaged also to define a first fluid chamber between the planar central portions of the plates and their respective engaged peripheral flanges 90. In this configuration, the outer peripheral edge portions 82 of the first pair of spaced-apart bosses 72,74 are engaged, with the respective fluid ports 87,86 and 86,87 being in communication. For the purposes of this disclosure, when two core plates are put together to form a plate pair defining a first fluid chamber therebetween, and a third plate is placed in juxtaposition with this plate pair, then the third plate defines a second fluid chamber between the third plate and the adjacent plate pair.

Referring in particular to FIG. 8, a T-shaped rib 92 is formed in the planar central portion 70. The height of rib 92 is equal to the height of peripheral flange 90. The head 94 of the T is located adjacent to the peripheral edge of the plate running behind bosses 76 and 78, and the stem 96 of the T extends longitudinally or inwardly between the second pair of spaced-apart bosses 76, 78. This T-shaped rib 92 engages the mating rib 92 on the adjacent plate and forms a barrier to prevent short-circuit flow between the inner peripheral edges 80 of the respective bosses 76 and 78. It will be appreciated that the continuous peripheral ridge 88 as seen in FIG. 9 also produces a continuous peripheral groove 98 as seen in FIG. 8. The T-shaped rib 92 prevents fluid from flowing from fluid ports 84 and 85 directly into the continuous groove 98 causing a short-circuit. It will be appreciated that the T-shaped rib 92 as seen in FIG. 8 also forms a complimentary T-shaped groove 100 as seen in FIG. 9. The Tshaped groove 100 is located between and around the outer peripheral edge portions 82 of bosses 76, 78, and this promotes the flow of fluid between and around the backside of these bosses, thus improving the heat exchange performance of heat exchanger 10.

In FIG. 9, the location of turbulizers 60 is indicated by chain dotted lines 102. In FIG. 8, the chain dotted lines 104 represent turbulizer 62. Turbulizer 62 could be formed of two side-by-side turbulizer portions or segments, rather than the single turbulizer as indicated in FIGS. 1 and 5 to 7. In FIG. 8, the turbulizer crimped portions 68 and 69 are indicated by the chain-dotted lines 105. These crimped portions 68 and 69 are located adjacent to the stem 96 of T-shaped rib 92 and also the inner edge portions 80 of bosses 76 and 78, to reduce short-circuit flow between bosses 76 and 78 around rib 96.

Core plates 16 to 22 also have another barrier located between the first pair of spaced-apart bosses 72 and 74. This barrier is formed by a rib 106 as seen in FIG. 9 and a complimentary groove 108 as seen in FIG. 8. Rib 106 prevents short-circuit flow between fluid ports 86 and 87 and again, the complimentary groove 108 on the water side of the core plates promotes flow between, around and behind the raised bosses 72 and 74 as seen in FIG. 8. It will be appreciated that the height of rib 106 is equal to the height of continuous ridge 88 and also the outer peripheral edge portions 82 of bosses 76 and 78. Similarly the height of the T-shaped rib or barrier 92 is equal to the height of peripheral flange 90 and the outer peripheral edge portions 82 of bosses 72 and 74. Accordingly, when the respective plates are placed in juxtaposition, U-shaped flow passages or chambers are formed between the plates. On the water side of the core plates (FIG. 8), this U-shaped flow passage is bounded by T-shaped rib 92, crimped portions 68 and 69 of turbulizer 62, and peripheral flange 90. On the oil side of the core plates (FIG. 9), this U-shaped flow passage is bounded by rib 106 and continuous peripheral ridge 88.

Referring once again to FIG. 1, heat exchanger 10 is assembled by placing turbulizer plate 24 on top of end plate 26. The flat side of turbulizer plate 24 goes against end plate 26, and thus undulating passageways 44 extend above central planar portion 40 allowing fluid to flow on both sides of plate 24 through undulating passageways 44 only. Core plate 22 is placed overtop turbulizer plate 24. As seen in FIG. 1, the water side (FIG. 8) of core plate 22 faces downwardly, so that bosses 72, 74 project downwardly as well, into engagement with the peripheral edges of openings 54 and 56. As a result, fluid flowing through openings 36 and 38 of end plate 26 pass through turbulizer openings 54, 56 and bosses 72, 74 to the upper or oil side of core plate 22.

Fluid flowing through fluid ports 84 and 85 of core plate 22 would flow downwardly and through the undulating passageways 44 of turbulizer plate 24. This flow would be in a U-shaped direction, because rib 48 in turbulizer plate 24 covers or blocks longitudinal groove 108 in core plate 22, and also because the outer peripheral edge portions of bosses 72, 74 are sealed against the peripheral edges of turbulizer openings 54 and 56, so the flow has to go around or past bosses 72,74. Further core plates are stacked on top of core plate 22, first back-to-back as is the case with core plate 20 and then face-to-face as is the case with core plate 18 and so on. Only four core plates are shown in FIG. 1, but of course, any number of core plates could be used in heat exchanger 10, as desired.

At the top of heat exchanger 10, the flat side of turbulizer plate 14 bears against the underside of end plate 12. The water side of core plate 16 bears against turbulizer plate 14. The peripheral edge portion 42 of turbulizer plate 14 is coterminous with peripheral flange 90 of core plate 14 and the peripheral edges of end plate 12, so fluid flowing through openings 28,30 has to pass transversely through openings 54,56 of turbulizer plate 14 to the water side of core plate 16. Rib 48 of turbulizer plate 14 covers or blocks groove 108 in core plate 14. From this, it will be apparent that fluid, such as water, entering opening 28 of end plate 12 would travel between turbulizer plate 14 and core plate 16 in a U-shaped fashion through the undulating passageways 44 of turbulizer plate 14, to pass up through opening 30 in end plate 12. Fluid flowing into opening 28 also passes downwardly through fluid ports 84 and 85 of respective core plates 16,18 to the U-shaped fluid chamber between core plates 18 and 20. The fluid then flows upwardly through fluid ports 84 and 85 of respective core plates 18 and 16, because the respective bosses defining ports 84 and 85 are engaged back-to-back. This upward flow then joins the fluid flowing through opening 56 to emerge from opening 30 in end plate 12. From this it will be seen that one fluid, such as coolant or water, passing through the openings 28 or 30 in end plate 12 travels through every other water side U-shaped flow passage or chamber between the stacked plates. The other fluid, such as oil, passing through openings 36 and 38 of end plate 26 flows through every other oil side U-shaped passage in the stacked plates that does not have the first fluid passing through it.

FIG. 1 also illustrates that in addition to having the turbulizers 60 and 62 orientated differently, the turbulizers can be eliminated altogether, as indicated between core plates 20 and 22. Turbulizer plates 14 and 24 are actually shim plates. Turbulizer plates 14, 24 could be replaced with turbulizers 60 or 62, but the height or thickness of such turbulizers would have to be half that of turbulizers 60 and 62 because the spacing between the central planar portions 70 and the adjacent end plates 12 or 26 is half as high the spacing between central planar portions 70 of the juxtaposed core plates 16 to 22.

Referring again to FIGS. 8 and 9, planar central portions 70 are also formed with further barriers 110 having ribs 112 on the water side of planar central portions 70 and complimentary grooves 114 on the other or oil side of central planar portions 70. The ribs 112 help to reduce bypass flow by helping to prevent fluid from passing into the continuous peripheral grooves 98, and the grooves 114 promote flow on the oil side of the plates by encouraging the fluid to flow into the corners of the plates. Ribs 112 also perform a strengthening function by being joined to mating ribs on the adjacent or juxtaposed plate. Dimples 116 are also provided in planar central portions 70 to engage mating dimples on juxtaposed plates for strengthening purposes.

Figure 12:
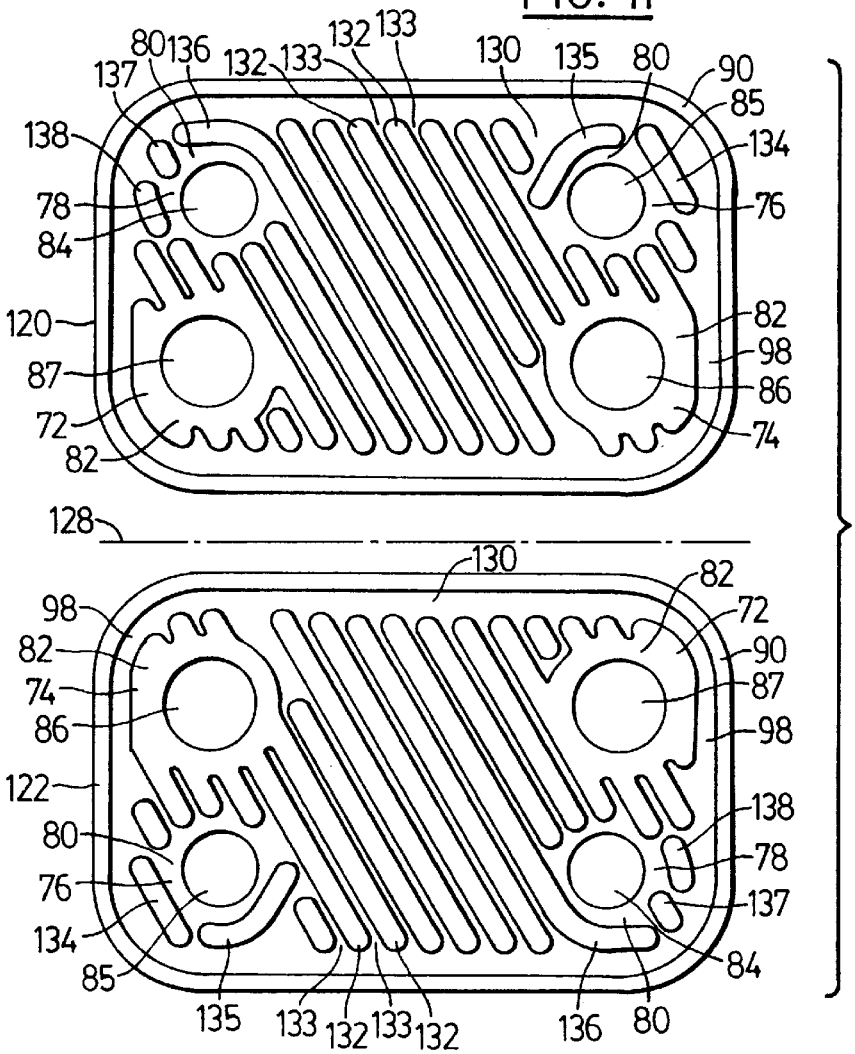
FIG. 12 is a plan view of the unfolded plates of a plate pair used to make another preferred embodiment of a self-enclosing heat exchanger according to the present invention.
Figure 13:
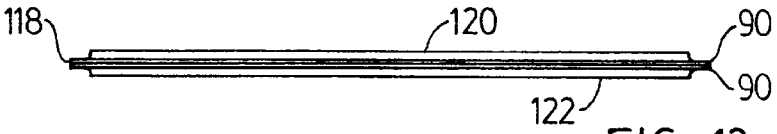
FIG. 13 is an elevational view of the assembled plate pair of FIG. 12.
Figure 14:
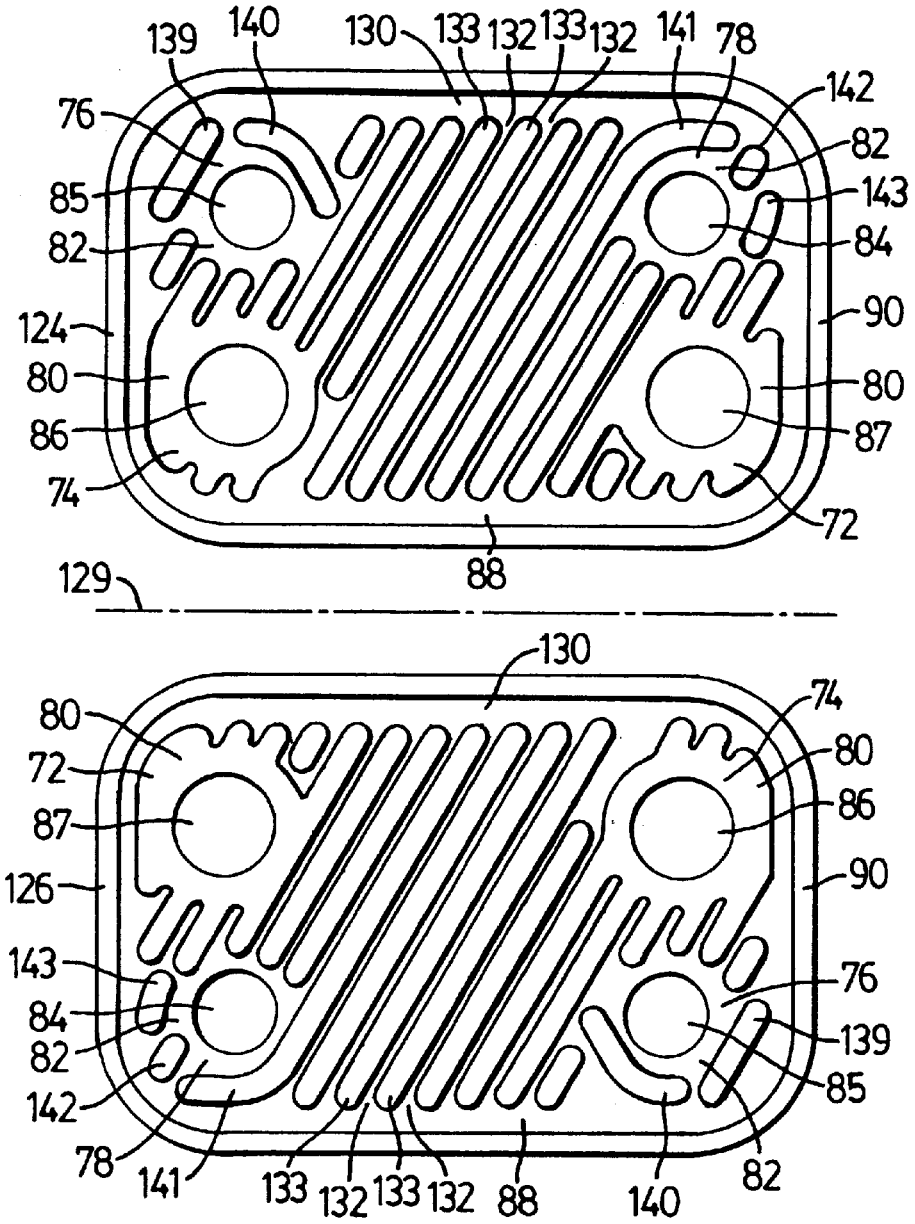
FIG. 14 is a plan view of the back sides of the unfolded plates shown in FIG. 12, where the plates are assembled back-to-back.
Figure 15:
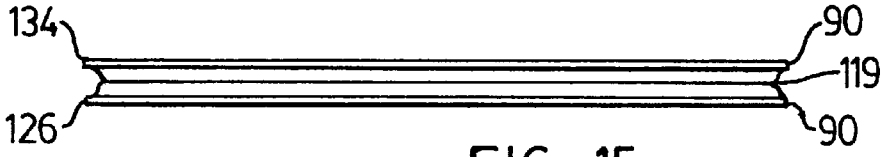
FIG. 15 is an elevational view of the assembled plate pairs of FIG. 14.
Figure 16:
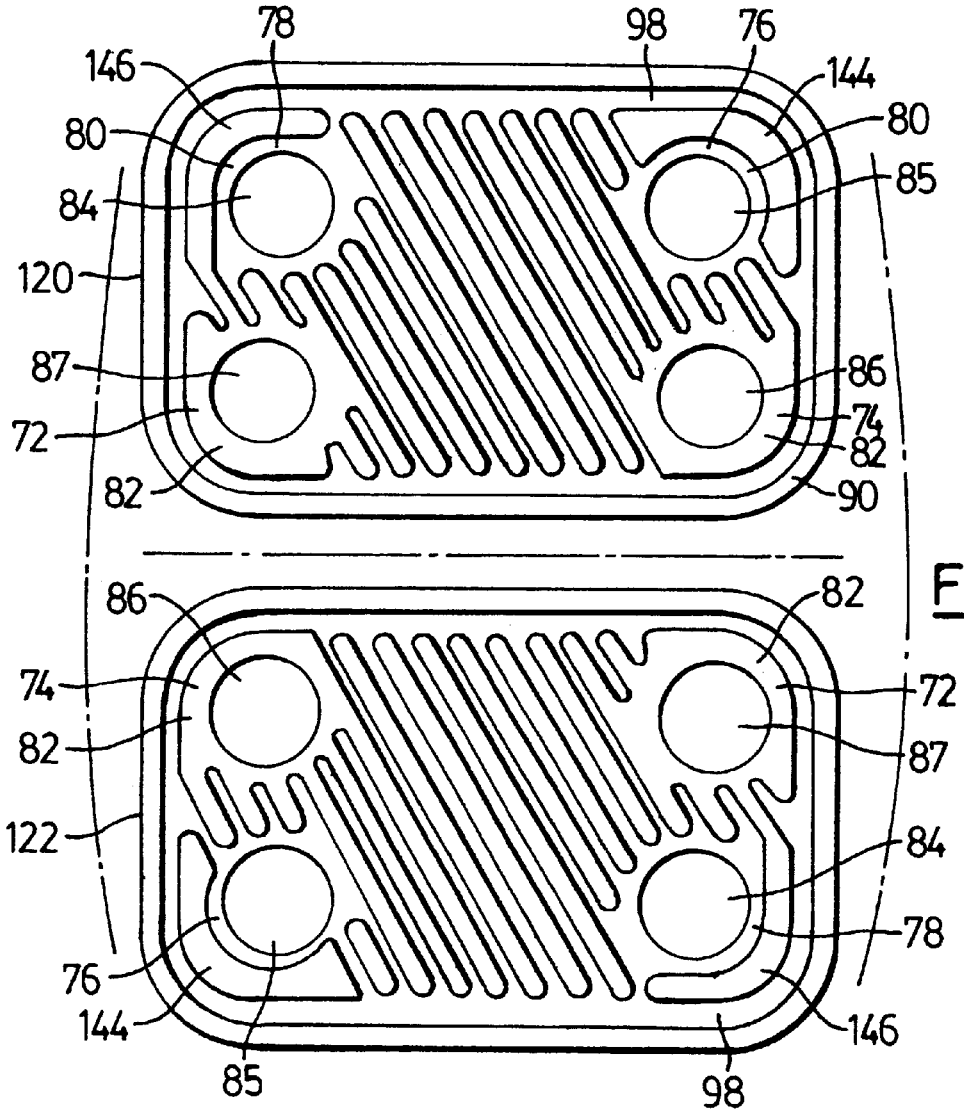
FIG. 16 is a plan view of the unfolded plates of a plate pair used to make another preferred embodiment of a self-enclosing heat exchanger according to the present invention.
Figure 17:
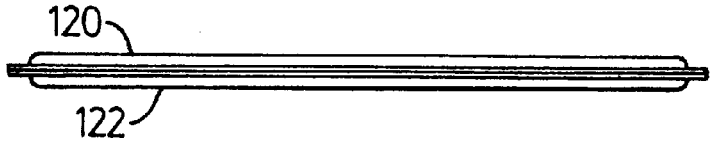
FIG. 17 is an elevational view of the assembled plates of FIG. 16.

Referring next to FIGS. 12 through 15, some plates are shown for producing another preferred embodiment of a self-enclosing heat exchanger according to the present invention. This heat exchanger is produced by stacking together a plurality of plate pairs 118 or 119. The plate pairs 118 are made up of plates 120 and 122, and the plate pairs 119 are made up of plates 124 and 126. Actually, all of the plates 120, 122, 124 and 126 are identical. FIGS. 12 and 13 show the plates 120, 122 juxtaposed in a face-to-face arrangement. FIGS. 14 and 15 show plates 124, 126 juxtaposed in a back-to-back arrangement. In FIG. 12, the plates of plate pair 118 are shown unfolded along a chain-dotted fold line 128, and in FIG. 14, the plates 124, 126 of plate pair 119 are shown unfolded along a chain-dotted fold line 129.

Core plates 120 to 126 are quite similar to the core plates shown in FIGS. 8 and 9, except that the bosses are located at the corners of the plates, and the first and second pairs of spaced-apart bosses 72,74 and 76,78 are located adjacent to the longitudinal sides of the rectangular plates, as opposed to being adjacent to the opposed ends of the plates as is the case with the embodiment of FIG. 1. Also, in place of turbulizers, the planar central portions 130 of the plates are formed with a plurality of angularly disposed alternating or undulating ribs 132 and grooves 133. What forms a rib on one side of the plate, forms a complimentary groove on the opposite side of the plate. When plate 120 is folded down on top of plate 122, and similarly when plate 124 is folded down on top of plate 126, the mating ribs and grooves 132, 133 cross to form undulating flow passages between the plates.

In the embodiment of FIGS. 12 to 15, the same reference numerals are used to indicate components or portions of the plates that are similar to those of the embodiment of FIG. 1. The difference between FIG. 12 and FIGS. 8 and 9, however, is that in FIG. 12 the water side of both plates is shown, whereas FIG. 8 shows the water side of one plate and FIG. 9 shows the oil side or the reverse side of the same plate. Similarly, FIG. 14 shows the oil side of both plates, whereas FIG. 9 shows the oil side of one plate and FIG. 8 shows the opposite or water side of the same plate.

In the embodiment of FIGS. 12 to 15, the barrier to reduce bypass flow is formed by a plurality of barrier segments or ribs 134, 135, 136, 137 and 138. These ribs 134 to 138 are spaced around the second pair of spaced-apart bosses 76,78 and help prevent fluid passing through openings 84 and 85 from flowing into the continuous peripheral groove 98. From the oil side of the plates, these ribs 134 to 138 form complimentary grooves 139, 140, 141, 142 and 143 (see FIG. 14). These grooves 139 to 143 promote the flow of fluids such as oil around and behind bosses 76 and 78.

As in the case of the FIG. 1 embodiment, any number of core plates 120 to 126 can be stacked to form a heat exchanger, and end plates (not shown) like end plates 12 and 26 can be attached to the core plates as well if desired.

Figure 18:
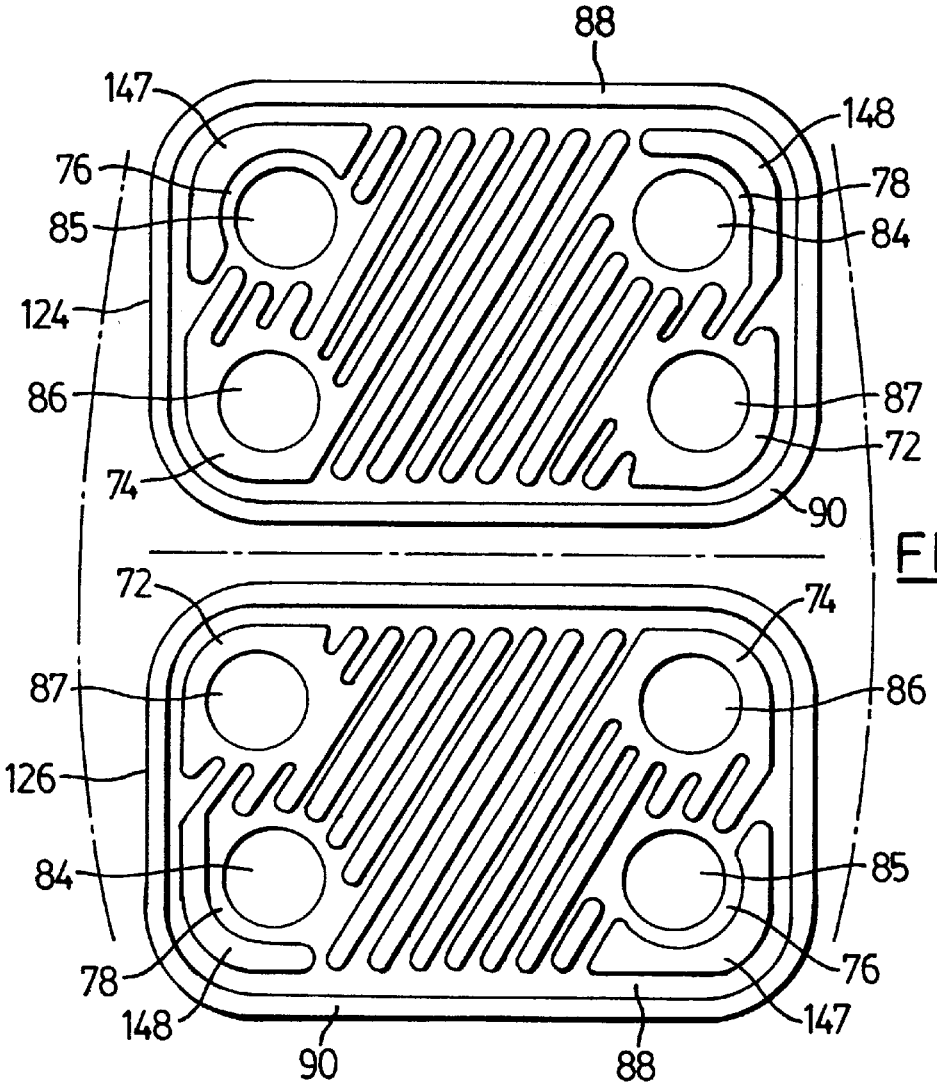
FIG. 18 is a plan view of the back sides of the unfolded plates shown in FIG. 16, where the plates are assembled back-to-back.
Figure 19:
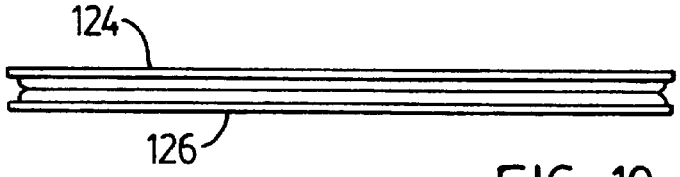
FIG. 19 is an elevational view of the assembled plates of FIG. 18.

FIGS. 16 to 19 show another preferred embodiment of a self-enclosing heat exchanger according to the present invention. This embodiment is very similar to the embodiment of FIGS. 12 to 15, but rather than having multiple rib segments to reduce bypass flow, two L-shaped ribs 144 and 146 are located between the second pair of spaced-apart bosses 76,78 to act as the barrier to reduce bypass flow between openings 84 and 85 and continuous peripheral groove 98. Ribs 144, 146 form complimentary grooves 147, 148 on the oil side of the plates, as seen in FIG. 18 to help promote flow from or to fluid ports 86 and 87 around and behind raised bosses 76 and 78.

Figure 20:
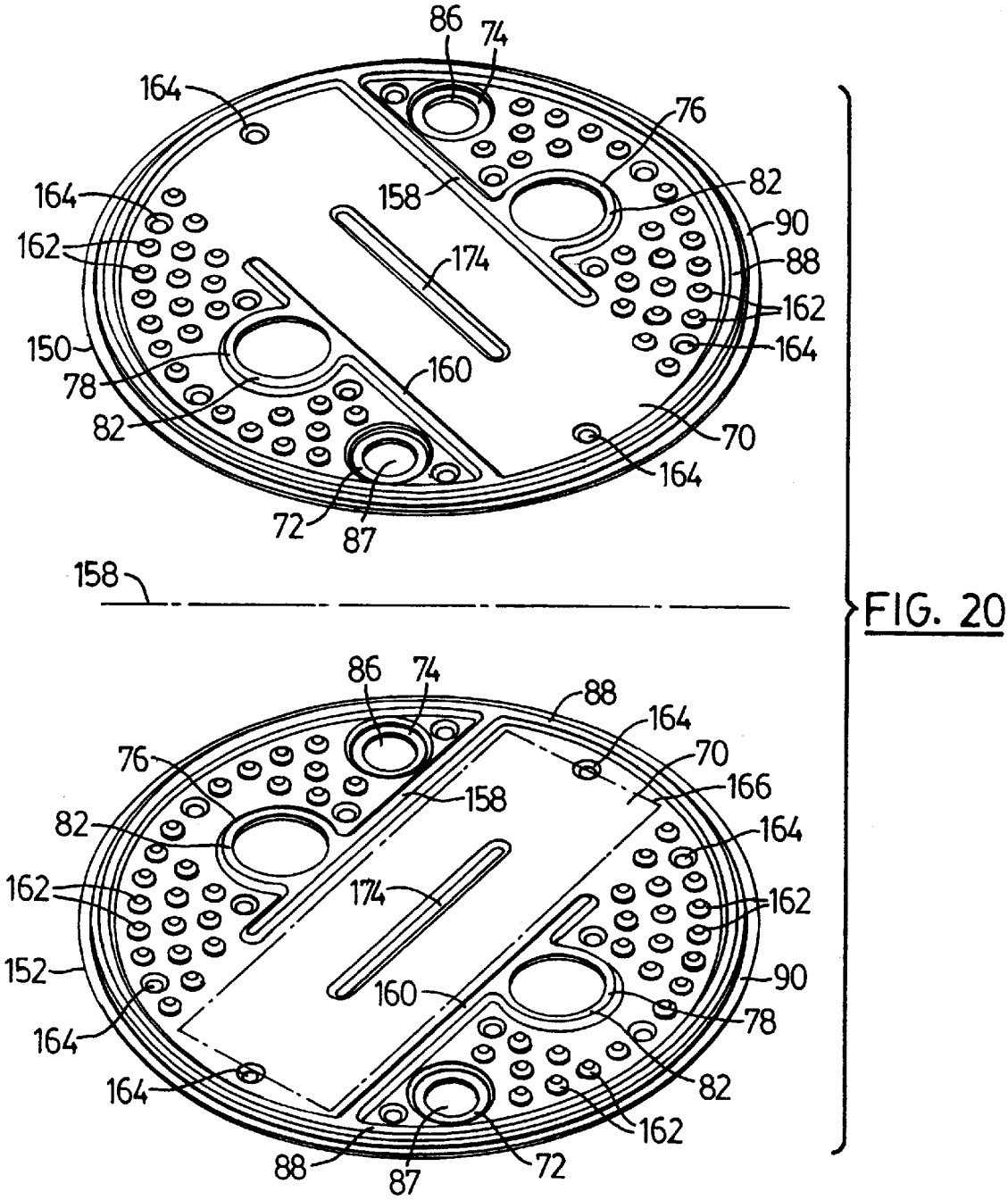
FIG. 20 is a perspective view of the unfolded plates of a plate pair used to make yet another preferred embodiment of a heat exchanger according to the present invention.
Figure 21:
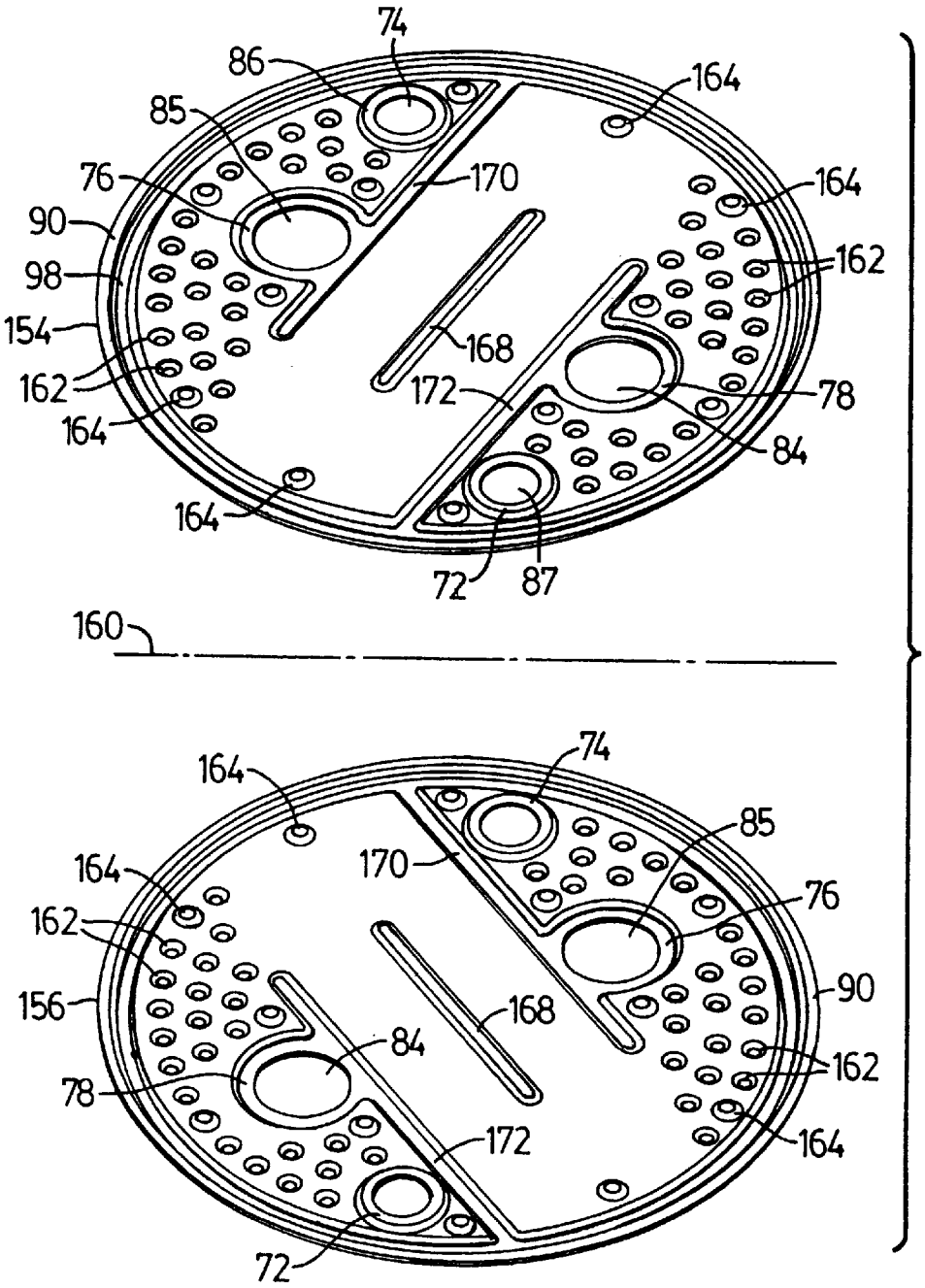
FIG. 21 is a perspective view similar to FIG. 20, but showing the unfolded plates where they would be folded together face-to-face.

Referring next to FIGS. 20 and 21, some further plates are shown for producing yet another preferred embodiment of a self-enclosing heat exchanger according to the present invention. In this embodiment, the plates 150, 152, 154 and 156 are circular and they are identical in plan view. FIG. 20 shows the oil side of a pair of plates 150, 152 that have been unfolded along a chain-dotted fold line 158. FIG. 21 shows the water side of a pair of plates 154, 156 that have been unfolded along a chain-dotted fold line 160. Again, core plates 150 to 156 are quite similar to the core plates shown in FIGS. 1 to 11, so the same reference numerals are used in FIGS. 20 and 21 to indicate components or portions of the plates that are functionally the same as the embodiment of FIGS. 1 to 11.

In the embodiment of FIGS. 20 and 21, the bosses of the first pair of spaced-apart bosses 72, 74 are diametrically opposed and located adjacent to the continuous peripheral ridge 88. The bosses of the second pair of spaced-apart bosses 76, 78 are respectively located adjacent to the bosses 74, 72 of the first pair of spaced-apart bosses. Bosses 72 and 78 form a pair of associated input and output bosses, and the bosses 74 and 76 form a pair of associated input and output bosses. Oil side barriers in the form of ribs 158 and 160 reduce the likelihood of short circuit oil flow between fluid ports 86 and 87. As seen best in FIG. 20, ribs 158, 160 run tangentially from respective bosses 76, 78 into continuous ridge 88, and the heights of bosses 76, 78, ribs 158, 160 and continuous ridge 88 are all the same. The ribs or barriers 158, 160 are located between the respective pairs of associated input and output bosses 74, 76 and 72, 78. Actually, barriers or ribs 158, 160 can be considered to be spaced-apart barrier segments located adjacent to the respective associated input and output bosses. Also, the barrier ribs 158, 160 extend from the plate central planar portions in the same direction and equidistantly with the continuous ridge 88 and the outer peripheral edge portions 82 of the second pair of spaced-apart bosses 76, 78.

A plurality of spaced-apart dimples 162 and 164 are formed in the plate planar central portions 70 and extend equidistantly with continuous ridge 88 on the oil side of the plates and raised peripheral flange 90 on the water side of the plates. The dimples 162, 164 are located to be in registration in juxtaposed first and second plates, and are thus joined together to strengthen the plate pairs, but dimples 162 also function to create flow augmentation between the plates on the oil side (FIG. 20) of the plate pairs. It will be noted that most of the dimples 162, 164 are located between the barrier segments or ribs 158, 160 and the continuous ridge 88. This permits a turbulizer, such as turbulizer 60 of the FIG. 1 embodiment, to inserted between the plates as indicated by the chain-dotted line 166 in FIG. 20.

On the water side of plates 154, 156 as seen in FIG. 21, a barrier rib 168 is located in the centre of the plates and is of the same height as the first pair of spaced-apart bosses 72, 74. Barrier rib 168 reduces short circuit flow between fluid ports 84 and 85. The ribs 168 are also joined together in the mating plates to perform a strengthening function.

Barrier ribs 158, 160 have complimentary grooves 170, 172 on the opposite or water sides of the plates, and these grooves 170, 172 promote flow to and from the peripheral edges of the plates to improve the flow distribution on the water side of the plates. Similarly, central rib 168 has a complimentary groove 174 on the oil side of the plates to encourage fluid to flow toward the periphery of the plates.

Figure 22:
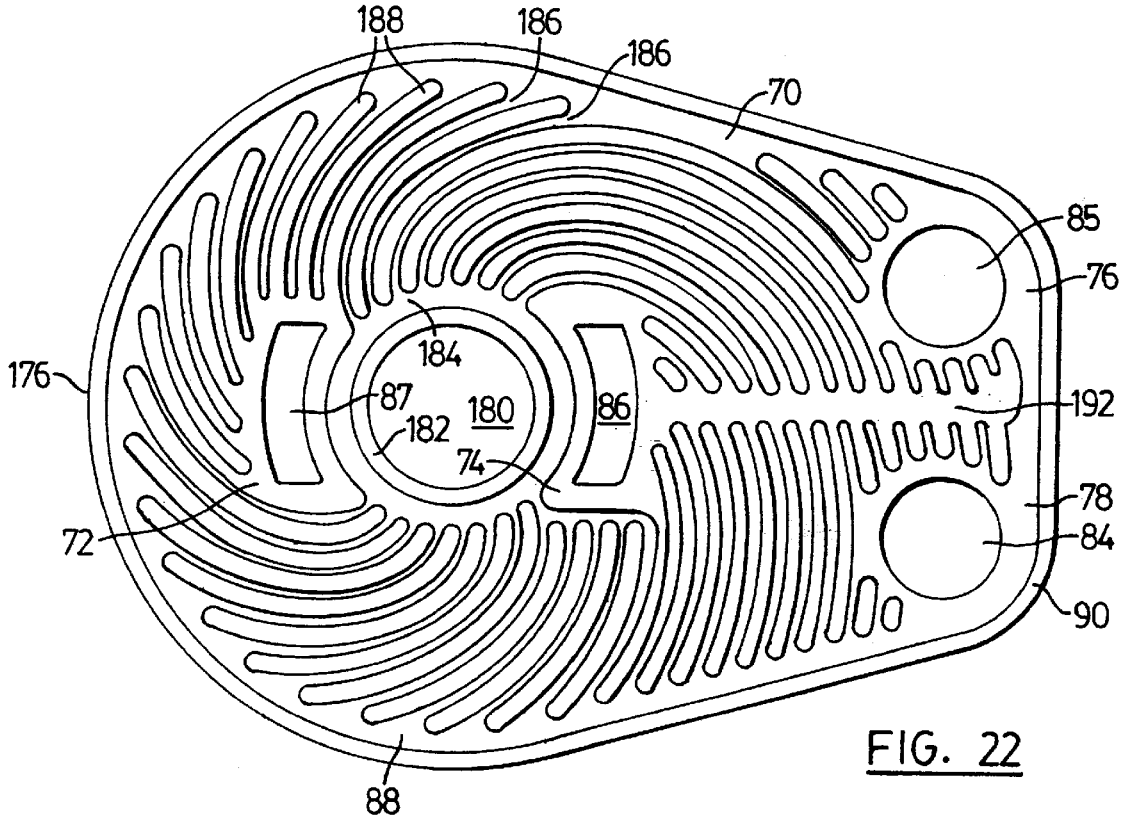
FIG. 22 is a plan view of one side of a plate used to make yet another preferred embodiment of a self-enclosing heat exchanger according to the present invention.
Figure 23:
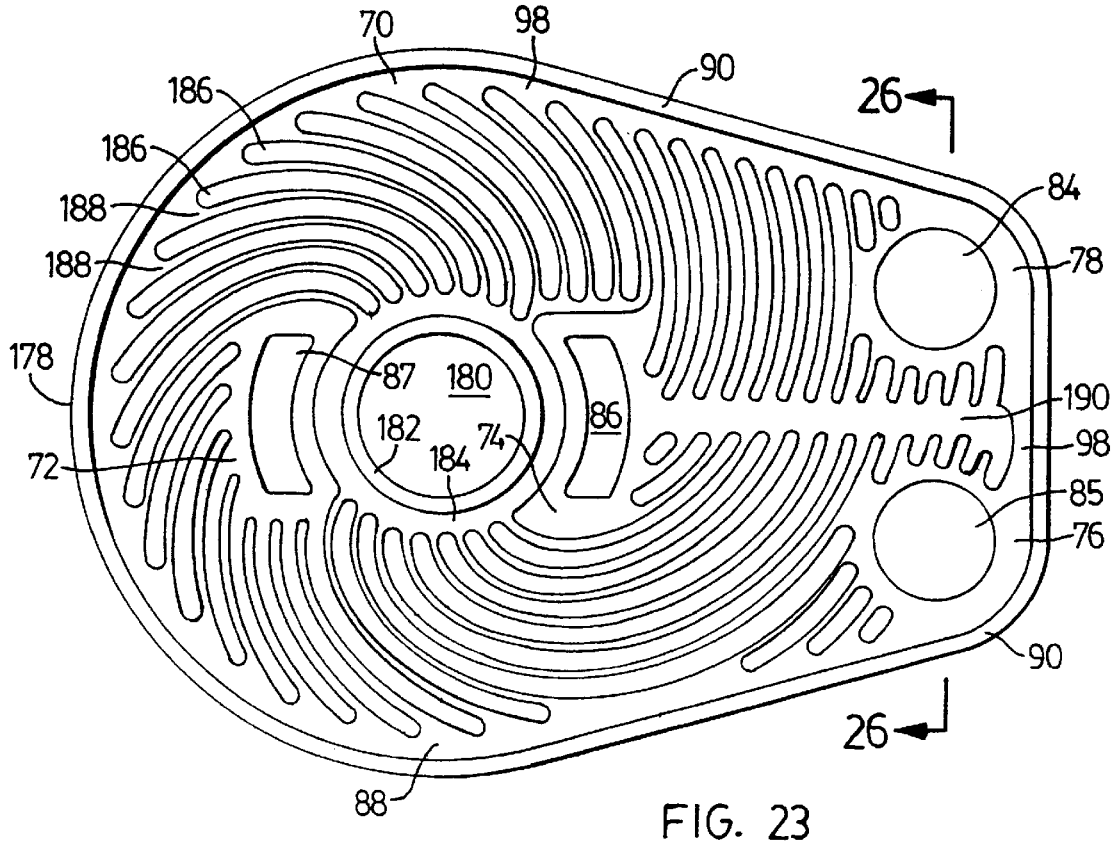
FIG. 23 is a plan view of the opposite side of the heat exchanger plate shown in FIG. 22.
Figure 26:
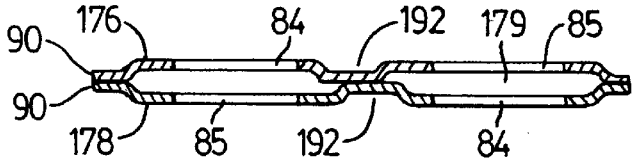
FIG. 26 is a vertical sectional view taken along lines 26—26 of FIG. 23 showing the plate of FIG. 22 on top of the plate of FIG. 23.

Referring next to FIGS. 22, 23 and 26, another type of plate is shown that is used to make a preferred embodiment of a self-enclosing heat exchanger according to the present invention. FIG. 22 shows the oil side of a core plate 176, and FIG. 23 shows the water side of a core plate 178. Actually, core plates 176, 178 are identical, and to form a plate pair, the core plates as shown in FIGS. 22 and 23 just need to be placed on top of one another. Where plate 176 as seen in FIG. 22, is moved downwardly and set on top of plate 178, an undulating water flow circuit 179 is provided between the plates (see FIG. 26) and where plate 178 is moved upwardly and placed on top of plate 176, an undulating oil flow passage is provided between the plates. Again, since many of the components of plates 176, 178 perform the same functions as the embodiments described above, the same reference numerals will be used in FIGS. 22 and 23 to indicate similar components or portions of the plates.

Plates 176, 178 are generally annular in plan view. The first pair of paced-apart bosses 72, 74 being located adjacent to and on the opposite sides of centre hole 180 in plates 176, 178. Hole 180 is defined by a peripheral flange 182 which is in a common plane with raised peripheral flange 90. An annular boss 184 surrounds peripheral flange 182. Boss 184 is in a common plane with continuous peripheral ridge 88. As in the case of the embodiments shown in FIGS. 12 to 19, the planar central portions 70 of the plates are formed with undulating ribs 186 and grooves 188. The ribs on one side of the plates form complimentary grooves on the opposite side of the plates. When the plates are stacked or juxtaposed against one another, the mating ribs and grooves 186, 188 cross to form undulating flow passages between the plates.

Since the bosses 72, 74 of the first pair of spaced-apart bosses 72, 74 are located on opposite sides of the centre hole 180, this is referred to as split flow. Fluid entering fluid port 86 goes both ways around centre opening 180 to fluid port 87. A second pair of spaced-apart bosses 76, 78 is located adjacent to the periphery of the extended end of the core plates. Flow through one of the fluid ports 84 or 85 thus travels in a U-shaped direction around centre hole 180 from one port to the other.

A radially disposed barrier rib 190 (see FIG. 23) extends from boss 74 outwardly between the first pair of spaced-apart bosses 76, 78, stopping just short of continuous peripheral groove 98. Boss 190 reduces short circuit flow between fluid ports 84 and 85. Since boss 190 also forms a complimentary radial groove 192 in the oil side of the plate as seen in FIG. 22, this groove 192 helps distribute or promotes the flow of fluid from fluid ports 86 and 87 outwardly to the extended end of the plates, again to improve the flow distribution between the plates.

Figure 24:
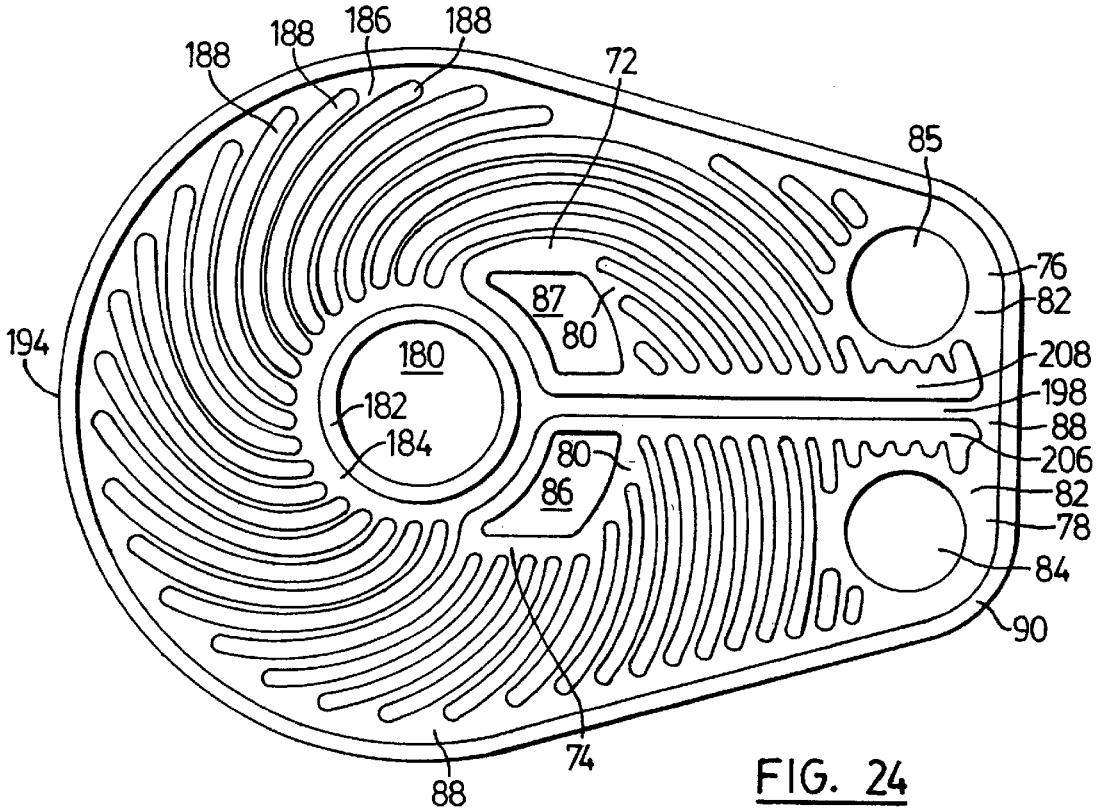
FIG. 24 is a plan view of a plate used to make yet another embodiment of a self-enclosing heat exchanger according to the present invention.
Figure 25:
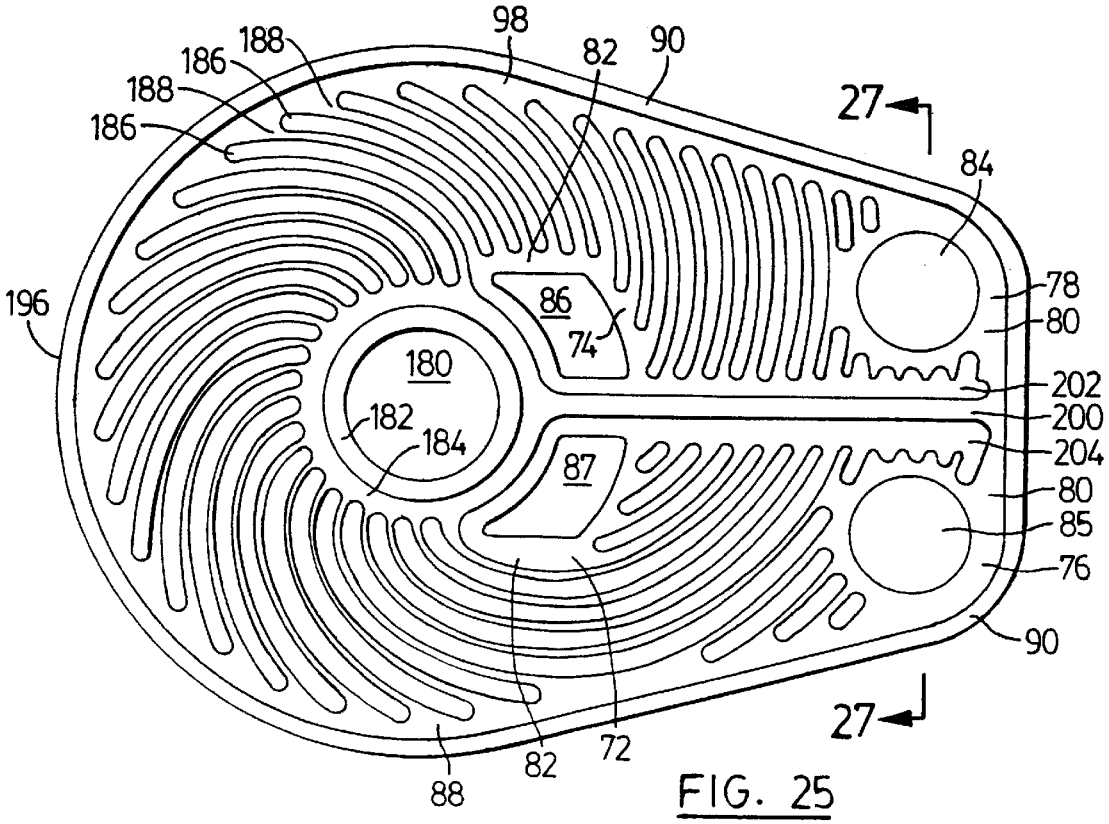
FIG. 25 is a plan view of the opposite side of the plate shown in FIG. 24.
Figure 27:
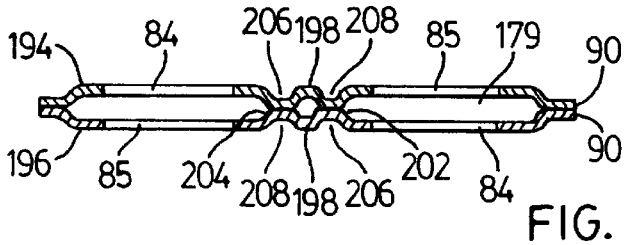
FIG. 27 is a vertical sectional view taken along lines 27—27 of FIG. 25 showing the plate of FIG. 24 on top of the plate of FIG. 25.

FIGS. 24, 25 and 27 show core plates 194, 196 that are quite similar to the core plates of FIGS. 22 and 23, but in core plates 194, 196, the bosses of the first pair of spaced-apart bosses 72, 74 are located adjacent to one another. This provides for circumferential flow around centre hole 80 from one of the fluid ports 86, 87 to the other. In this embodiment, a barrier rib 198 extends from the central annular boss 184 between both pairs of spaced-apart bosses 72, 74 and 76, 78 to continuous ridge 88. This barrier rib 198 prevents bypass flow between fluid ports 86 and 87. Rib 198 also has a complimentary groove 200 on the water side of the plates as seen in FIG. 25.

In addition to barrier 198 on the oil side of the plates, two additional or further barrier ribs 202 and 204 are provided on the water side of the plates on either side of radial groove 200. Barrier ribs 202 and 204 are the same height as bosses 72 and 74 and raised peripheral flange 90, and extend from the outer peripheral edge portions 82 of bosses 72,74 to between the inner peripheral edge portions 80 of the bosses 76, 78. These bosses 202, 204 also form complimentary radial grooves 206, 208 on the oil side of the plates as seen in FIGS. 24 and 27. These oil side grooves 206, 208 extend from the inner peripheral edge portions 80 of bosses 72, 74 to between the outer peripheral edge portions 82 of bosses 76, 78, and promote the flow of fluid from fluid ports 86 and 87 out toward the peripheral end of the plates between bosses 76 and 78. In the embodiment of FIGS. 24 and 25, the first rib 198 extends from between the inner peripheral edge portions 80 of the first pair of spaced-apart bosses 72, 74 to between the outer peripheral edge portions 82 of the second pair of spaced-apart bosses 76, 78. The complimentary groove 200 extends from between the inner peripheral edge portions 80 of the second pair of spaced-apart bosses 76, 78 to between the outer peripheral edge portion 82 of the first pair of spaced25 apart bosses 72, 74.

Figure 28:
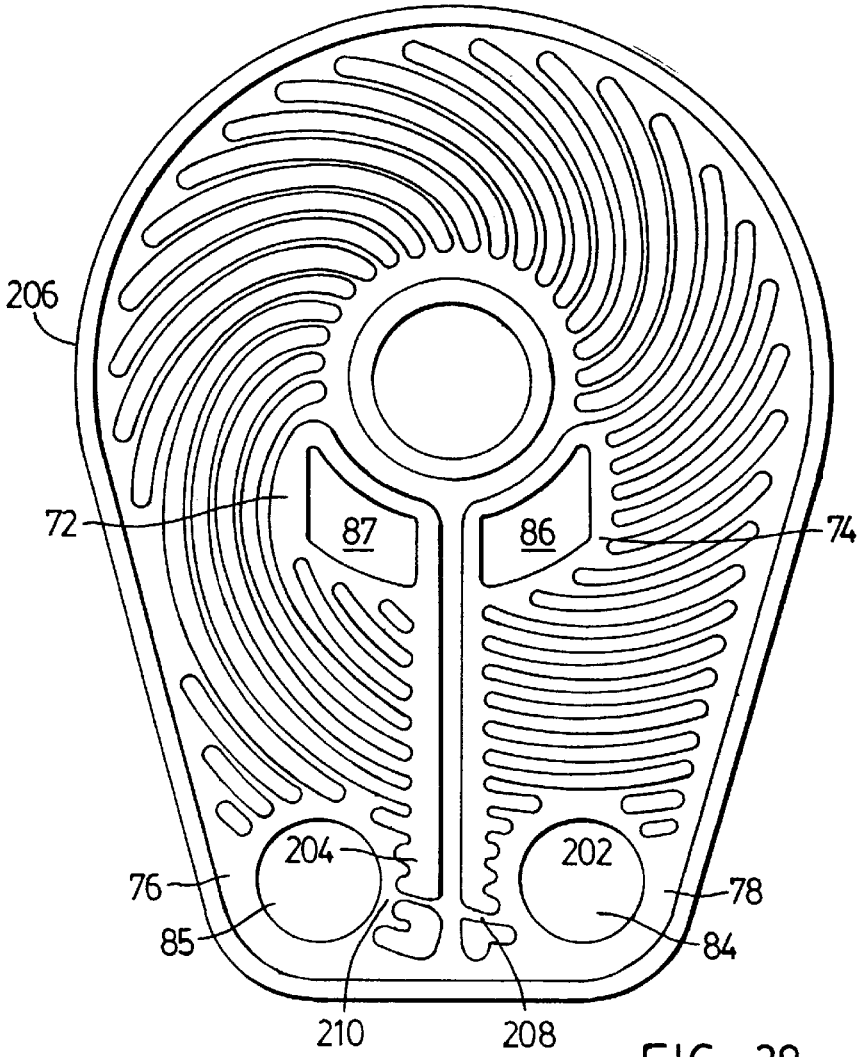
FIG. 28 is a plan view similar to FIG. 25 but showing a modification to provide controlled bypass between the input and output ports of the plate pairs.

FIG. 28 shows a core plate 206 which is similar to the core plates 194 and 196 of FIGS. 24 and 25, but core plate 206 has calibrated bypass channels 208 and 210 formed in barrier ribs 202, 204 to provide some deliberate bypass flow between fluid ports 84 and 85. As mentioned above, this calibrated bypass may be used where it is desirable to reduce the pressure drop inside the plate pairs. Such bypass channels could be incorporated into the end plates of the heat exchanger rather than the core plates, however, as in the case of the embodiment of FIG. 1. Similar bypass channels could also be employed in the embodiment of FIGS. 22 and 23, if desired.

Referring next to FIGS. 29 to 32, yet another embodiment of a self-enclosing heat exchanger will now be described. In this embodiment, a plurality of elongate flow directing ribs are formed in the plate planar central portions to prevent short-circuit flow between the respective ports in the pairs of spaced-apart bosses. In FIGS. 29 to 32, the same reference numerals are used to indicate parts and components that are functionally equivalent to the embodiments described above.

Figure 29:
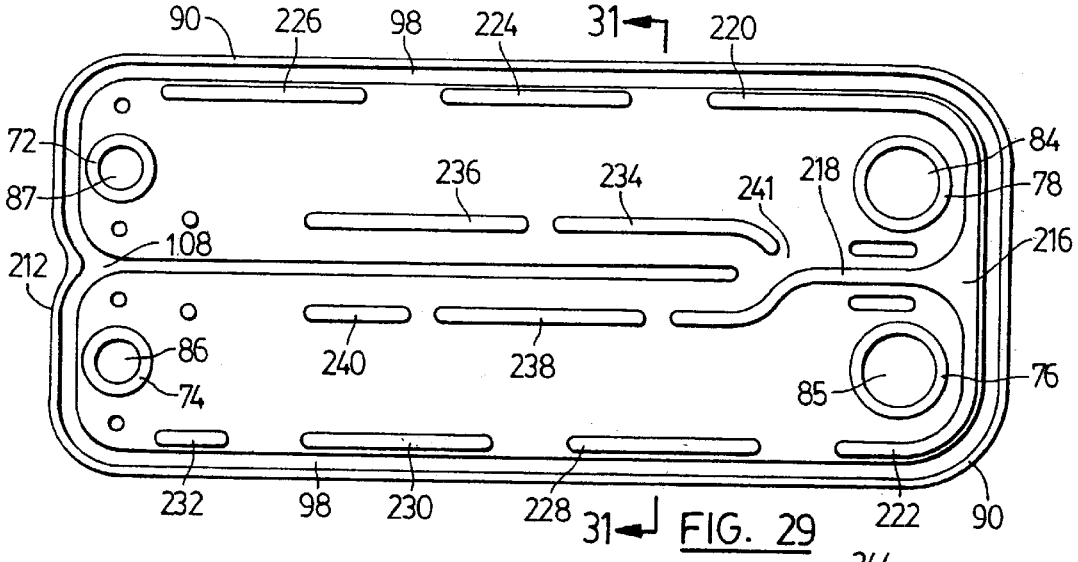
FIG. 29 is a plan view of yet another preferred embodiment of a plate used to make a self-enclosing heat exchanger according to the present invention.
Figure 30:
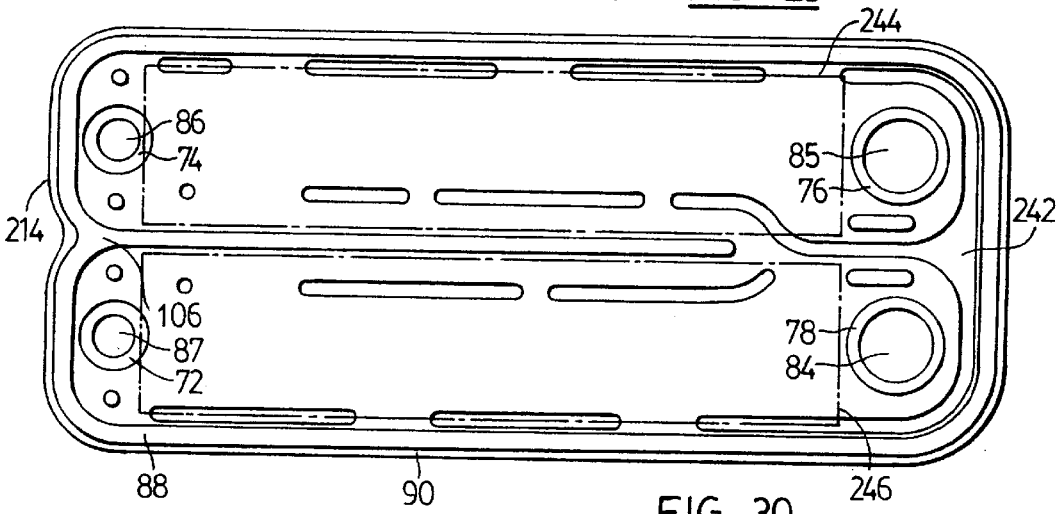
FIG. 30 is a plan view of the opposite side of the plate shown in FIG. 29.
Figure 31:
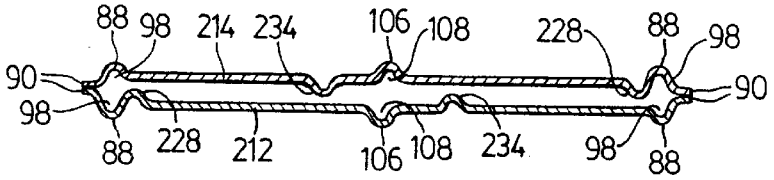
FIG. 31 is a vertical sectional view in along lines 31—31 of FIG. 29, but showing the assembled plates of FIGS. 29 and 30.
Figure 32:
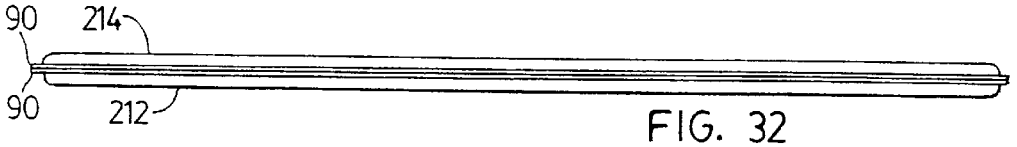
FIG. 32 is a vertical elevational view of the assembled plates of FIGS. 29 to 31.

FIG. 29 shows a core plate 212 that is similar to core plates 16, 20 of FIG. 1, and FIG. 30 shows a core plate 214 that is similar to core plates 18, 22 of FIG. 1. In core plate 212, the barrier rib between the second pair of spaced-apart bosses 76, 78 is more like a U-shaped rib 216 that encircles bosses 76, 78, but it does have a central portion or branch 218 that extends between the second pair of spaced-apart bosses 76, 78. The U-shaped portion of rib 216 has distal branches 220 and 222 that have respective spaced-apart rib segments 224, 226 and 228, 230 and 232. The distal branches 220 and 222, including their respective rib segments 224, 226 and 228, 230 and 232 extend along and adjacent to the continuous peripheral groove 98. Central branch or portion 218 includes a bifurcated extension formed of spaced-apart segments 234, 236, 238 and 240. It will be noted that all of the rib segments 224 through 240 are asymmetrically positioned or staggered in the plates, so that in juxtaposed plates having the respective raised peripheral flanges 90 engaged, the rib segments form half-height overlapping ribs to reduce bypass or short-circuit flow into the continuous peripheral groove 98 or the central longitudinal groove 108. It will also be noted that there is a space 241 between rib segment 234 and branch 218. This space 241 allows some flow therethrough to prevent stagnation which otherwise may occur at this location. As in the case of the previously embodiments, the U-shaped rib 216 forms a complimentary groove 242 on the oil side of the plates as seen in FIG. 30. This groove 242 promotes the flow of fluid between, around and behind bosses 76, 78 to improve the efficiency of the heat exchanger formed by plates 212, 214. The oil side of the plates can also be provided with turbulizers as indicated by chain-dotted lines 244, 246 in FIG. 30. These turbulizers preferably will be the same as turbulizers 60 in the embodiment of FIG. 1. It is also possible to make the bifurcated extension of central branch 218 so that the forks consisting of respective rib segments 234, 236 and 238, 240 diverge. This would be a way to adjust the flow distribution or flow velocities across the plates and achieve uniform velocity distribution inside the plates.

Referring next to FIGS. 33 to 36, yet another embodiment of a self-enclosing heat exchanger is shown wherein the same reference numerals are used to indicate parts and components that are functionally equivalent to the embodiments described above. In this embodiment, a core plate 250 has a linear flow configuration with the inlet and outlet ports located adjacent to opposed ends of the heat exchanger. Core plate 250 has a raised central planar portion 252 extending between but slightly below end bosses 76, 78. A downwardly disposed peripheral rib 254 (see FIG. 35) surrounds planar portion 252, so that where two plates 250 are juxtaposed with peripheral flanges 90 engaged, an inner flow channel or first fluid chamber 256 is formed in the plate pair between fluid ports 86, 87. Rib 254 also forms a peripheral groove 258 just inside continuous ridge 88 that communicates with fluid ports 84, 85 in end bosses 72, 74. Where two plates 250 are juxtaposed with continuous ridges 88 engaged, the opposed peripheral grooves 258 form a channel communicating with fluid ports 84, 85 to form the second fluid chamber.

Fluid passing between fluid ports 84, 85 would normally tend to bypass through peripheral grooves 258 and not flow between or around the first fluid chambers 256. In order to avoid this, barrier ribs 260 are formed in plates 250 to block peripheral grooves 258. This causes the fluid to flow inwardly between the central planar portions 252 that form chambers 256. Barrier ribs 260 also form complementary grooves 262 that promote flow from inner or first fluid chamber 256 to another peripheral channel 264 formed by the mating continuous ridges 88.

It will be appreciated that barrier ribs 260 are located between the inner peripheral edge portions 80 of the bosses of the pair of bosses 72, 74 to reduce short-circuit flow therebetween. Similarly, complementary grooves 262 are located between the bosses of the pair of bosses 72, 74 to promote flow therebetween, namely, through peripheral grooves or channels 258.

Barrier ribs 260 can be located at any point along peripheral grooves 258, and ribs 260 could be any width desired in the longitudinal direction of plates 250. Alternatively, more than one barrier rib 260 could be located in each of the peripheral grooves 258.

Figure 33:
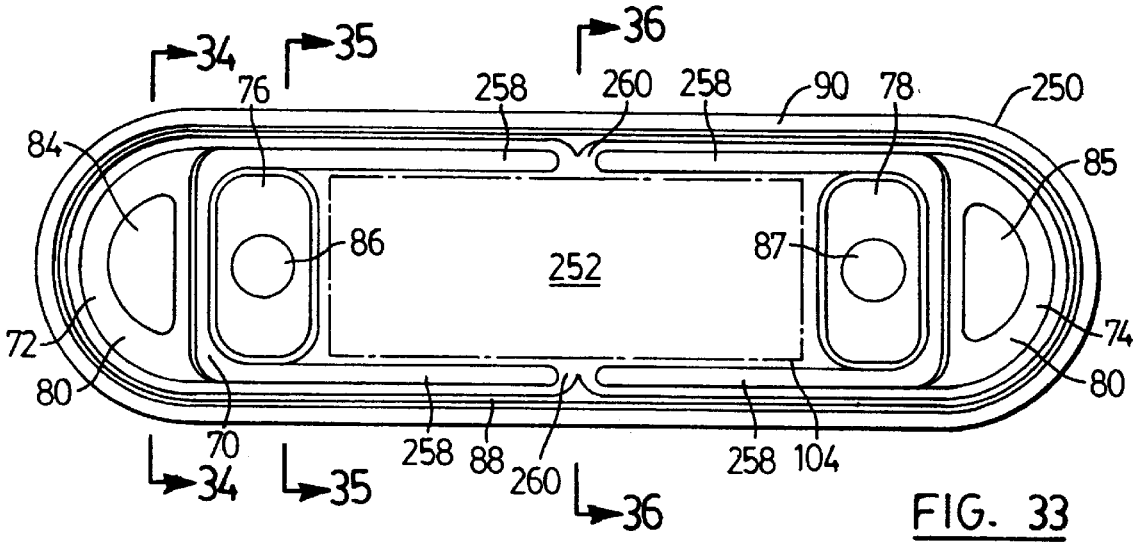
FIG. 33 is a plan view of one side of a plate used to make yet another preferred embodiment of a self-enclosing heat exchanger according to the present invention.
Figure 35:
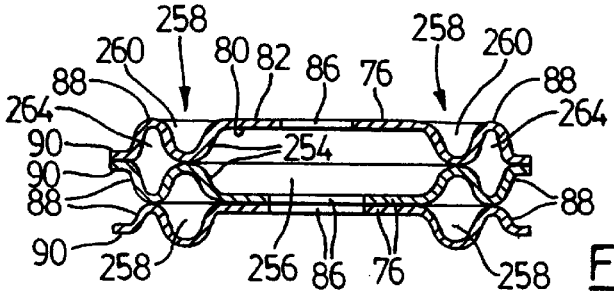
FIG. 35 is a cross-sectional view taken along lines 35—35 of FIG. 33, but showing another plate pair stacked on top of the plate of FIG. 33.
Figure 36:
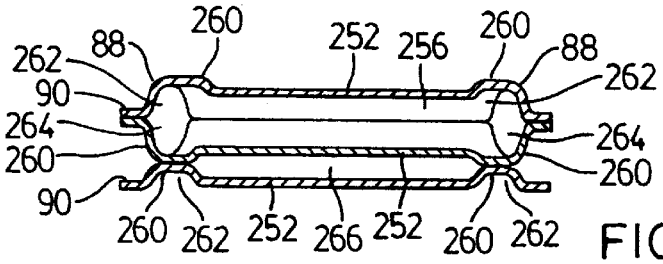
FIG. 36 is a cross-sectional view taken along lines 36—36 of FIG. 33 but showing another plate pair stacked on top of the plate of FIG. 33.
Figure 34:
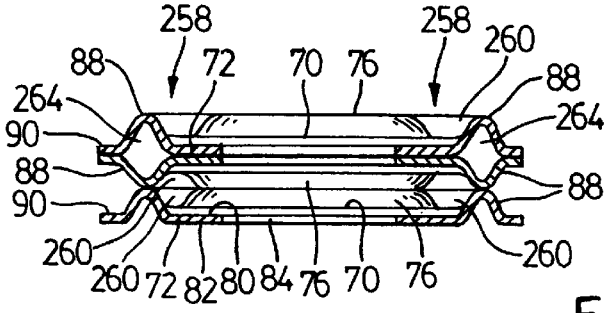
FIG. 34 is a cross-sectional view taken along lines 34—34 of FIG. 33, but showing another plate pair stacked on top of the plate of FIG. 33.

FIG. 33 indicates by chain dotted line 104 that a turbulizer could be located inside first fluid chamber 256. A turbulizer could also be located between the central planar portions 252 forming adjacent first fluid chambers 256, as indicated by space 266 in FIG. 36. Space 266 is actually part of the second fluid chamber that extends between fluid ports 84 and 85. Alternatively, mating dimples or crossing ribs and grooves could be used instead of turbulizers as in the previously described embodiments.

In the embodiment shown in FIGS. 33 to 36, where the heat exchanger is used as a water cooled oil cooler, fluid ports 86, 87 and first fluid chamber 256 would normally be the oil side of the cooler, and fluid ports 84, 85 and second fluid chamber 266 would be the water side of the heat exchanger.

In the above description, for the purposes of clarification, the terms oil side and water side have been used to describe the respective sides of the various core plates. It will be understood that the heat exchangers of the present invention are not limited to the use of fluids such as oil or water. Any fluids can be used in the heat exchangers of the present invention. Also, the configuration or direction of flow inside the plate pairs can be chosen in any way desired simply by choosing which of the fluid flow ports 84 to 87 will be inlet or input ports and which will be outlet or output ports.

Having described preferred embodiments of the invention, it will be appreciated that various modifications may be made to the structures described above. For example, the heat exchangers can be made in any shape desired. Although the heat exchangers have been described from the point of view of handling two heat transfer fluids, it will be appreciated that more than two fluids can be accommodated simply by nesting or expanding around the described structures using principles similar to those described above. Further, some of the features of the individual embodiments described above can be mixed and matched and used in the other embodiments as will be appreciated by those skilled in the art.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A plate type heat exchanger comprising:

first and second plates, each plate including a planar central portion, a first pair of spaced-apart bosses extending from one side of the planar central portion, and a second pair of spaced-apart bosses extending from the opposite side of the planar central portion, said bosses each having an inner peripheral edge portion, and an outer peripheral edge portion defining a fluid port; a continuous ridge encircling the inner peripheral edge portions of at least the first pair of bosses and extending from the planar central portion in the same direction and equidistantly with the outer peripheral edge portions of the second pair of bosses;

each plate including a raised peripheral flange extending from the planar central portion in the same direction and equidistantly with the outer peripheral edge portions of the first pair of bosses;

the first and second plates being juxtaposed so that one of: the continuous ridges are engaged and the plate peripheral flanges are engaged; thereby defining a first fluid chamber between the engaged ridges or peripheral flanges; the fluid ports in the respective first and second pairs of spaced-apart bosses being in registration;

a third plate being located in juxtaposition with one of the first and second plates to define a second fluid chamber between the third plate and the central planar portion of the adjacent plate; and each planar central portion including a barrier formed of a rib and complementary groove, the rib being located between the inner peripheral edge portions of the bosses of one of the pairs of bosses to reduce short-circuit flow therebetween, and the complementary groove also being located between the bosses of said one pair of bosses to promote flow therebetween.

2. A plate type heat exchanger as claimed in claim 1 and further comprising a turbulizer located between the first and second plate planar central portions.

3. A plate type heat exchanger as claimed in claim 1 wherein the planar central portions include a plurality of angularly disposed ribs and grooves, said ribs and grooves crossing in juxtaposed plates to form undulating flow passages between the fluid ports of the respective pairs of spaced-apart bosses.

4. A plate type heat exchanger as claimed in claim 1 wherein the plate central portions include a plurality of spaced-apart dimples formed therein extending equidistantly with one of the continuous ridge and raised peripheral flange, the dimples being located to be in registration in juxtaposed first and second plates.

5. A plate type heat exchanger as claimed in claim 1 wherein the plate planar central portion includes a plurality of elongate flow directing ribs formed therein, said ribs being arranged to prevent short-circuit flow between the respective ports in the pairs of spaced-apart bosses.

6. A plate type heat exchanger as claimed in claim 1 wherein the continuous ridge encircles both the first and second pairs of spaced-apart bosses.

7. A plate type heat exchanger as claimed in claim 1 wherein the barrier rib is located between the first pair of spaced-apart bosses, and wherein the height of the rib is equal to the height of the continuous ridge.

8. A plate type heat exchanger as claimed in claim 1 wherein the barrier rib is located between the second pair of spaced-apart bosses and height of rib is equal to the height of peripheral flange.

9. A plate type heat exchanger as claimed in claim 2 wherein the first and second plate continuous ridges are engaged, and wherein the turbulizer is located in the first fluid chamber defined thereby.

10. A plate type heat exchanger as claimed in claim 2 wherein the first and second plate peripheral flanges are engaged and wherein the turbulizer is located in the first fluid chamber defined thereby.

11. A plate type heat exchanger as claimed in claim 1 wherein the first plate is identical to the second plate, the first and second plates being juxtaposed so that the plate raised peripheral flanges are engaged, the outer peripheral edge portions of the first pair of spaced-apart bosses of both plates being engaged, the respective fluid ports therein being in communication.

12. A plate type heat exchanger as claimed in claim 11 wherein the third plate is identical to the first and second plates, the third plate continuous ridge engaging the continuous ridge of the juxtaposed plate, the outer peripheral edge portions of the second pair of spaced-apart bosses in the third plate engaging the outer peripheral edge portions of the second pair of spaced-apart bosses in the juxtaposed plate, the respective fluid ports therein being in communication.

13. A plate type heat exchanger as claimed in claim 12 and further comprising a turbulizer located inside each of the first and second chambers located between the plates.

14. A plate type heat exchanger as claimed in claim 6 wherein the plates are rectangular in plan view, and wherein the first and second pairs of spaced-apart bosses are located adjacent to opposed ends of the plates, and wherein the barrier extends between the second pair of spaced-apart bosses.

15. A plate type heat exchanger as claimed in claim 14 wherein the barrier is T-shaped in plan view, the head of the T being located adjacent to the peripheral edge of the plate and the stem of the T extending inwardly between the second pair of spaced-apart bosses.

16. A plate type heat exchanger as claimed in claim 6 wherein the plates are rectangular in cross-section, the spaced-apart bosses are located at the corners of the plates, the barrier is formed of a plurality of barrier segments, and said segments are spaced around the bosses of the second pair of spaced-apart bosses.

17. A plate type heat exchanger as claimed in claim 6 wherein the plates are circular in plan view, the bosses of the first pair of spaced-apart bosses are diametrically opposed and located adjacent to the continuous ridge, the bosses of the second pair of spaced-apart bosses are respectively located adjacent to the bosses of the first pair of spaced-apart bosses to form pairs of associated input and output bosses, and the barrier is located between the respective pairs of associated input and output bosses.

18. A plate type heat exchanger as claimed in claim 17 wherein the plate planar central portions include a plurality of spaced-apart dimples formed therein extending equidistantly with one of the continuous ridge and raised peripheral flange, the dimples being located to be in registration in juxtaposed first and second plates.

19. A plate type heat exchanger as claimed in claim 6 wherein the plates are generally annular in plan view, the first pair of spaced-apart bosses being located adjacent to the centre of the plates, the second pair of spaced-apart bosses being located adjacent to the periphery of the plates, the barrier extending radially between the bosses of the first pair of spaced-apart bosses.

20. A plate type heat exchanger as claimed in claim 19 wherein the barrier extends radially between both pairs of spaced-apart bosses.

21. A plate type heat exchanger as claimed in claim 20 wherein the barrier includes a calibrated bypass channel therein communicating with the respective bosses of the second pair of spaced-apart bosses.

22. A plate type heat exchanger as claimed in claim 5 wherein said barrier is a first barrier, and further comprising a second barrier having a rib extending between the inner peripheral edge portions of the bosses of the second pair of spaced-apart bosses.

23. A plate type heat exchanger as claimed in claim 22 wherein the second barrier rib includes a central portion extending between the second pair of spaced-apart bosses, and a U-shaped portion encircling the inner peripheral edge portions of the bosses of the second pair of spaced-apart bosses.

24. A plate type heat exchanger as claimed in claim 23 wherein said U-shaped portion includes distal branches having spaced-apart rib segments extending along the continuous peripheral groove.

25. A plate type heat exchanger as claimed in claim 23 wherein said central portion includes a bifurcated extension, said extension being formed of spaced-apart segments.

26. A plate type heat exchanger as claimed in claim 24 wherein said rib segments are asymmetrically positioned in the plates, so that in juxtaposed plates having the raised peripheral flanges engaged, said segments form half-height overlapping ribs to reduce bypass flow into the continuous peripheral groove.

27. A plate type heat exchanger as claimed in claim 25 wherein said rib segments are asymmetrically positioned in the plates, so that in juxtaposed plates having the raised peripheral flanges engaged, said segments form half-height overlapping ribs to reduce bypass flow into the continuous peripheral groove.

28. A plate type heat exchanger as claimed in claim 1 and further comprising top and bottom end plates mounted respectively on top of and below said first, second and third plates, said end plates having openings communicating with respective fluid ports in adjacent plates, one of the end plates defining a controlled bypass groove extending between said openings therein.

* * * * *